US009061503B2

(12) United States Patent
Shinkai

(10) Patent No.: US 9,061,503 B2
(45) Date of Patent: Jun. 23, 2015

(54) SUCTION DEVICE, SUCTION METHOD, AND EJECTION DEVICE

(71) Applicant: SEIKO EPSON CORPORATION, Tokyo (JP)

(72) Inventor: Katsumi Shinkai, Fujimi-machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/167,338

(22) Filed: Jan. 29, 2014

(65) Prior Publication Data

US 2014/0218438 A1 Aug. 7, 2014

(30) Foreign Application Priority Data

Feb. 5, 2013 (JP) ..... 2013-020174

(51) Int. Cl.
*B41J 2/165* (2006.01)

(52) U.S. Cl.
CPC ..... *B41J 2/16532* (2013.01); *B41J 2/16547* (2013.01); *B41J 2/1652* (2013.01); *B41J 2/16508* (2013.01); *B41J 2/16523* (2013.01)

(58) Field of Classification Search
CPC ..... B41J 2/16523; B41J 2/16532; B41J 2/16508; B41J 2/1652; B41J 2/16547
USPC ..... 347/30
See application file for complete search history.

(56) References Cited

U.S. PATENT DOCUMENTS

| | | | | |
|---|---|---|---|---|
| 4,155,583 | A * | 5/1979 | Mikos et al. | 294/65 |
| 5,110,265 | A * | 5/1992 | Kato et al. | 417/279 |
| 5,126,766 | A * | 6/1992 | Terasawa et al. | 347/30 |
| 2006/0132533 | A1 * | 6/2006 | Mochizuki | 347/30 |
| 2007/0247486 | A1 * | 10/2007 | Sakurai | 347/30 |
| 2008/0136864 | A1 * | 6/2008 | Nakamura et al. | 347/30 |

FOREIGN PATENT DOCUMENTS

| | | |
|---|---|---|
| JP | A-2002-200777 | 7/2002 |
| JP | B2-4010854 | 11/2007 |
| JP | A-2009-051122 | 3/2009 |
| JP | A-2010-221492 | 10/2010 |

* cited by examiner

*Primary Examiner* — Manish S Shah
*Assistant Examiner* — Yaovi Ameh
(74) *Attorney, Agent, or Firm* — Oliff PLC

(57) ABSTRACT

A suction device for an ejection head provided with a nozzle includes a cap capable of sealing a nozzle surface provided with the nozzle, a decompression pump serving as a decompression device, and a suction passage provided between the cap and the decompression pump. The negative pressure level of the suction passage set by the decompression pump are controlled on the basis of a volume of the suction passage such that a liquid with which the ejection head has been filled is sucked out from the nozzle.

18 Claims, 12 Drawing Sheets

SUCTION DEVICE, SUCTION METHOD, AND EJECTION DEVICE

BACKGROUND

1. Technical Field

The present invention relates to a suction device that sucks out a liquid, with which an ejection head provided with a nozzle has been filled, from the nozzle, a suction method that eliminates clogging of the nozzle, and an ejection device provided with the suction device.

2. Related Art

As an example of the ejection head described above, there is known an ink jet head that includes a plurality of nozzles, a compression chamber that is provided in each of the plurality of nozzles and that is in communication with the corresponding nozzle, an actuator provided in each compression chamber, and a cavity that is commonly in communication with the compression chambers provided in the nozzles. A printing apparatus (printer), for example, provided with such an ink jet head is capable of drawing characters and graphics onto an object to be ejected, such as a sheet of recording paper, by ejecting ink, which is a liquid, from the nozzles in the form of droplets onto the object to be ejected.

In the printing apparatus (printer) described above, if a nozzle of the ink jet head is clogged by solidified ink, foreign matter, or bubbles, ink will not be ejected from the nozzle or a failure such as flight deflection, a failure in which the ink fails to land at the desired position on the object to be ejected, will occur. Accordingly, there are cases in which the desired printing results cannot be obtained. Therefore, the printing apparatus described above is provided with a maintenance mechanism that eliminates clogging of the plurality of nozzles of the ink jet head.

For example, Japanese Patent No. 4010854 discloses an apparatus for manufacturing a functional element substrate in which the apparatus includes a reliability maintaining device having an elastic cap that is pressed onto an ejection head (ink jet head) to seal nozzles and a suction pump that performs sucking from a hole that is in communication with the elastic cap.

A solution that is fed to the ejection head is retained in a separate container and the container and the ejection head are connected through a flexible supply line. At least two types of filters are provided downstream of the container. The filter provided most downstream is incorporated into the ejection head in a non-detachable manner, and the filter upstream of the most downstream filter is provided in a detachable manner. The filter provided most downstream has a smaller filter capacity and a larger filter mesh size than the filter provided upstream. Furthermore, the above-mentioned Japanese Patent No. 4010854 states that the amount of solution sucked by the reliability maintaining device is equivalent to or larger than the internal volume of the area downstream of the filter provided most downstream. Accordingly, the above-mentioned Japanese Patent No. 4010854 states that clogging of the ejection head can be eliminated and the apparatus for manufacturing a functional element substrate can be operated in a stable manner.

The above-mentioned Japanese Patent No. 4010854 states that the required minimum quantity of the suction volume of the solution of the reliability maintaining device has been made clear. However, setting the suction volume of the suction pump does not necessarily achieve reliable suction of the required minimum quantity of solution. For example, depending on the decompressed state of the flexible supply line between the elastic cap and the suction pump, the suction volume may disadvantageously change. In other words, more than the amount of solution required to eliminate the clogging of the nozzle may be excessively sucked. Furthermore, since foreign matter may be disadvantageously included in the sucked solution, it is difficult to reuse the sucked solution after the sucked solution is discharged. Accordingly, when the solution is very expensive, a demand for reducing the amount of solution that is sucked and disposed arises. In other words, there is a need to reduce the amount of solution that is sucked for eliminating clogging of the nozzles as much as possible.

SUMMARY

The invention is addressed to overcome at least some of the problems described above and can be implemented in the following embodiments and applications.

Application 1

A suction device for an ejection head provided with a nozzle, according to a first aspect of the invention includes a cap that is capable of sealing a nozzle surface provided with the nozzle, a decompression device, and a suction passage provided between the cap and the decompression device. In the suction device, a liquid with which the ejection head has been filled is sucked out from the nozzle by controlling a negative pressure level of the suction passage on the basis of a volume of the suction passage with the decompression device.

According to the configuration of the present application, a suction volume of the suction device is a product of a volume of the suction passage and a negative pressure level of the suction passage that works against the pressure inside the cap when the nozzle surface is sealed by the cap. Accordingly, compared with a case in which the suction volume is set by continuously performing sucking with the decompression device and, for example, controlling the suction time, suction volume can be controlled more easily. Therefore, a suction device capable of sucking the desired amount of liquid can be provided.

Application 2

The suction device according to the application preferably further includes a first on-off valve provided in the suction passage on a cap side thereof and a second on-off valve provided in the suction passage on a decompression device side thereof.

According to such a configuration, the volume of the suction passage can be determined by providing the first and second on-off valves. Accordingly, by closing the first on-off valve and opening the second on-off valve, decompressing the suction passage with the decompression device, and, then, closing the second on-off valve, the suction passage can be consistently brought to a desired negative pressure level. Therefore, the suction volume can be controlled more easily.

Application 3

In the suction device according to the application, the ejection head preferably includes a liquid supply port, a plurality of the nozzles, and a cavity that is in communication with the plurality of the nozzles, and the negative pressure level of the suction passage is preferably set such that the amount of liquid equal to or less than a volume from the liquid supply port to the plurality of the nozzles including the cavity is sucked out.

According to such a configuration, excessive suction of the liquid from the ejection head can be suppressed.

Application 4

In the suction device according to the application, the suction passage preferably includes a first suction passage and a second suction passage that are connected in series through a third on-off valve.

According to such a configuration, suction can be performed in a stepwise manner on the basis of the volume and the negative pressure level of the first suction passage and those of the second suction passage. In other words, compared with a case in which the liquid is sucked out with a single suction, excessive suction of the liquid from the ejection head can be suppressed. Furthermore, suction can be performed in a stepwise manner by opening and closing the third on-off valve; accordingly, there is no need to repeat the decompression of the decompression device.

Application 5

In the suction device according to the application, the suction passage preferably includes a first suction passage and a second suction passage that are connected in series through a third on-off valve, and a suction bypass passage that is connected in parallel with the suction passage and that is connected between the cap and the decompression device, in which the suction bypass passage bypasses the suction passage.

According to such a configuration, in accordance with the clogging state of the nozzle, sucking performed in a stepwise manner with the first suction passage and the second suction passage and sucking performed in a continuous manner with the suction bypass passage can be performed in combination, for example.

Application 6

In the suction device according to the application, the suction passage preferably includes a first suction passage and a second suction passage that are connected in parallel, a first on-off valve may be provided on each of a cap side of the first suction passage and the second suction passage, and a second on-off valve may be provided on each of a decompression device side of the first suction passage and the second suction passage.

According to such a configuration, suction can be performed in a stepwise manner on the basis of the volume and the negative pressure level of the first suction passage and those of the second suction passage. Furthermore, compared with a case in which the first suction passage and the second suction passage are connected in series, decompression of the suction passage can be performed more easily.

Application 7

In the suction device according to the application, a volume of the first suction passage and a volume of the second suction passage are preferably substantially the same.

According to such a configuration, sucking with similar levels of suction volumes can be repeated.

Application 8

In the suction device according to the application, a volume of the first suction passage and a volume of the second suction passage are preferably different.

According to such a configuration, sucking with different levels of suction volumes can be performed in accordance with the clogging state of the nozzle.

Application 9

In the suction device according to the application, a volume of the cap when the nozzle surface is sealed is preferably smaller than a volume of the suction passage.

According to such a configuration, substantial variation in suction volume caused by the volume of the cap can be suppressed.

Application 10

In the suction device according to the application, the suction passage is preferably connected to a plurality of the caps, and a volume of the plurality of the caps when sealing a plurality of the nozzle surfaces therewith is preferably smaller than a volume of the suction passage.

According to such a configuration, substantial variation in suction volume caused by the volumes of the plurality of caps can be suppressed.

Application 11

A suction method according to a second aspect of the invention is a suction method of sucking a liquid with which an ejection head has been filled out from a nozzle, the suction method including: using a suction device including a cap that is capable of sealing a nozzle surface provided with the nozzle, a decompression device, a suction passage provided between the cap and the decompression device, a first on-off valve provided in the suction passage on a cap side thereof, and a second on-off valve provided in the suction passage on a decompression device side thereof; decompressing the suction passage to a predetermined negative pressure level with the decompression device by closing the first on-off valve and opening the second on-off valve; and sucking by opening the first on-off valve after closing the first on-off valve, closing the second on-off valve, and sealing the nozzle surface with the cap.

The suction volume according to the suction method of the present application is a product of a volume of the suction passage between the first on-off valve and the second on-off valve and the negative pressure level of the suction passage that works against the pressure inside the cap when the nozzle surface is sealed by the cap. Accordingly, compared with a case in which the suction volume is set by continuously performing sucking with the decompression device and by controlling the suction time, for example, suction volume can be controlled more easily. Therefore, a suction method capable of sucking the desired amount of liquid can be provided.

Application 12

In the suction method according to the application, the ejection head preferably includes a liquid supply port, a plurality of the nozzles, and a cavity that is in communication with each of the plurality of the nozzles, and during the decompressing, the negative pressure level of the suction passage is preferably set such that the amount of liquid equal to or less than a volume from the liquid supply port to the plurality of nozzles including the cavity is sucked out during the sucking.

According to such a method, excessive suction of the liquid from the ejection head can be suppressed.

Application 13

In the suction method according to the application, the suction passage preferably includes a first suction passage and a second suction passage that are connected in series through a third on-off valve, and the sucking preferably includes a first suction process in which sucking is performed by opening the first on-off valve and closing the third on-off valve and the second on-off valve and a second suction process, performed after the first suction process, in which sucking is performed by opening the third on-off valve.

According to such a method, suction can be performed in a stepwise manner by a first suction process that is based on the volume and the negative pressure level of the first suction passage and by a second suction process that is based on the volume and the negative pressure level of the second suction passage. In other words, compared with a case in which the liquid is sucked out with a single suction, excessive suction of the liquid from the ejection head can be suppressed. Furthermore, suction can be performed in a stepwise manner by opening and closing the third on-off valve; accordingly, there is no need to repeat the decompression of the decompression device.

Application 14

In the suction method according to the application, the suction passage preferably includes a first suction passage and a second suction passage that are connected in series through a third on-off valve, and a suction bypass passage that is connected between the cap and the decompression device and that is connected in parallel with the first suction passage and the second suction passage, the suction bypass passage bypassing the first suction passage and the second suction passage, and the sucking preferably includes a first suction process in which sucking is performed by opening the first on-off valve and closing the third on-off valve and the second on-off valve, a second suction process in which sucking is performed by opening the third on-off valve after the first suction process, and a third suction process in which sucking is performed by closing the second on-off valve and through the suction bypass passage with the decompression device.

According to such a method, sucking performed in a stepwise manner with the first suction process and the second suction process and sucking performed in a continuous manner with the third suction process that performs bypassing with the suction bypass passage can be performed in combination according to the clogging state of the nozzle.

Application 15

In the suction method according to the application, the suction passage preferably includes a first suction passage and a second suction passage that are connected in parallel, the first suction passage and the second suction passage each preferably include a first on-off valve and a second on-off valve, and the sucking preferably includes a first suction process in which sucking is performed by closing the first on-off valve and the second on-off valve of the second suction passage, closing the second on-off valve of the first suction passage, and opening the first on-off valve of the first suction passage, and a second suction process in which, after the first suction process, sucking is performed by closing the first on-off valve of the first suction passage and opening the first on-off valve of the second suction passage.

According to such a method, suction can be performed in a stepwise manner with the first suction process and the second suction process. Furthermore, compared with a case in which the first suction passage and the second suction passage are connected in series, decompression of the suction passage can be performed more easily during the decompressing.

Application 16

The suction method according to the application preferably further includes: discharging the liquid remaining inside the suction passage before the decompressing.

According to such a method, since the liquid inside the suction passage is discharged before the decompressing, compared with a case in which there is liquid inside the suction passage during decompressing, negative pressure level of the suction passage can be appropriately obtained. In other words, sucking can be performed accurately.

Application 17

An ejection device according to a third aspect of the invention includes an ejection head and a suction device according to the above-described applications.

According to such a configuration, wasteful consumption of the liquid by the suction device can be reduced and clogging of the nozzle can be eliminated; therefore, an ejection device that is capable of ejecting a liquid onto an object to be ejected in a stable manner can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
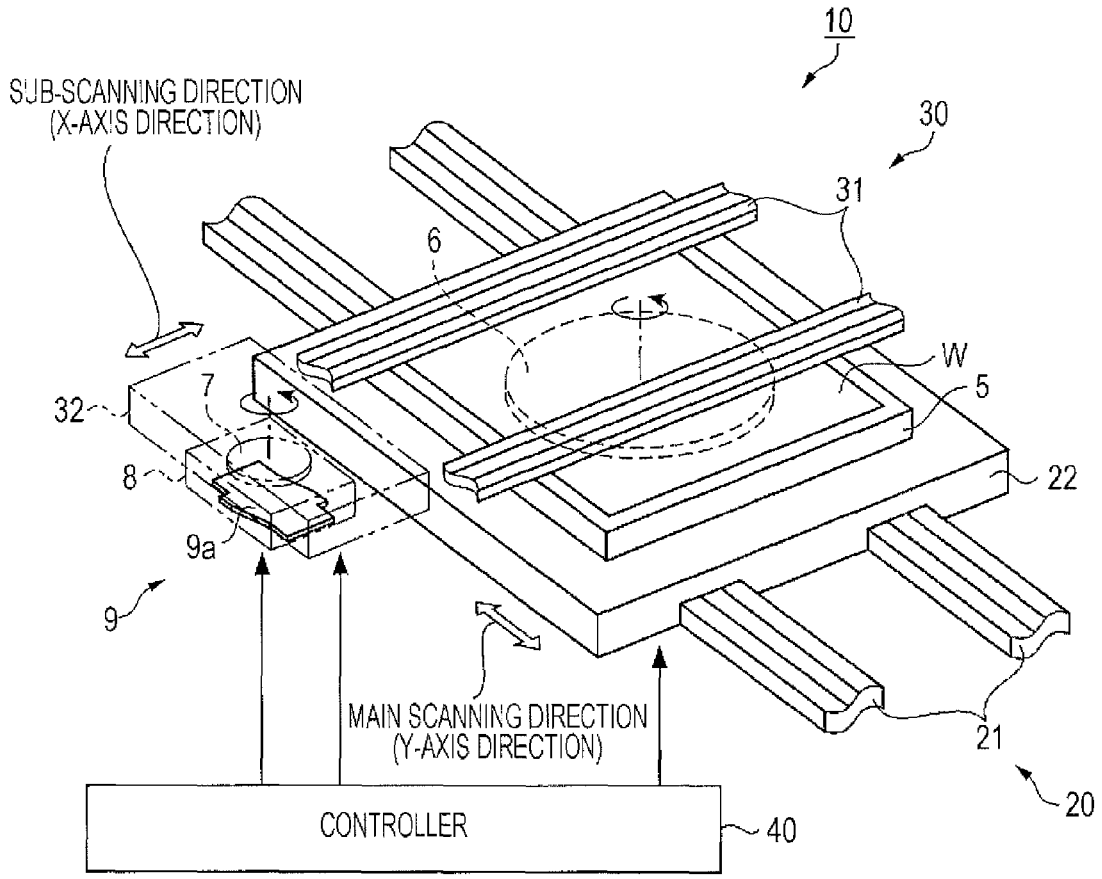
FIG. 1 is a schematic perspective view illustrating a configuration of an ejection device of a first embodiment.

Embodiments embodying the invention will be described below in accordance with the drawings. Note that in the drawings used herein, the portions that are to be described are enlarged or reduced in size as required so as to be perceivable.

First Embodiment

Ejection Device

An ejection device that is provided with a suction device of the first embodiment will be described with reference to FIGS. 1 to 5. FIG. 1 is a schematic perspective view illustrating a configuration of the ejection device of the first embodiment.

As illustrated in FIG. 1, an ejection device 10 of the embodiment is a device that ejects a functional liquid (liquid) including a functional material from ejection heads 50 (see FIG. 2A) that include nozzles onto an object to be ejected such as a tabular workpiece W. The ejection device 10 includes a workpiece moving mechanism 20 that moves the workpiece W in a main scanning direction (Y-axis direction) and a head moving mechanism 30 that moves a head unit 9 in a sub-scanning direction (X-axis direction) that is orthogonal to the main scanning direction. The ejection heads 50 are mounted in the head unit 9.

The workpiece moving mechanism 20 includes a pair of guide rails 21, a moving table 22 that moves along the pair of guide rails 21, a stage 5, on which the workpiece W is placed, that is disposed above the moving table 22 with a rotation mechanism 6 therebetween.

An air slider and a linear motor (both not shown) that are provided inside the guide rails 21 move the moving table 22 in the main scanning direction (Y-axis direction). The moving table 22 is provided with an encoder 12 (see FIG. 5) serving as a timing signal generator.

In accordance with the relative movement of the moving table 22 in the main scanning direction (Y-axis direction), the encoder 12 reads the scale on a linear scale (not shown), which is arranged side by side with the guide rails 21, and generates an encoder pulse serving as a timing signal. Note that the disposition of the encoder 12 is not limited to the above position. For example, when the moving table 22 is configured to relatively move along a rotation shaft in the main scanning direction (Y-axis direction) and a drive unit that rotates the rotation shaft is provided, then, the encoder 12 may be provided in the drive unit. The drive unit includes, for example, a servomotor.

The stage 5 is capable of sucking and fixing the workpiece W thereto and, with the rotation mechanism 6, is capable of accurately adjusting the reference axes of the workpiece W in the main scanning direction (Y-axis direction) and the sub-scanning direction (X-axis direction).

Furthermore, the workpiece W may be turned, for example, 90 degrees in accordance with the arrangement of the ejection area (also referred to as a film formation area) of the workpiece W where the functional liquid is ejected.

The head moving mechanism 30 includes a pair of guide rails 31 and a moving table 32 that moves along the pair of guide rails 31. A carriage 8 is suspended from the moving table 32 with the rotation mechanism 7 therebetween.

The head unit 9 that has a head plate 9*a*, to which a plurality of ejection heads 50 (see FIG. 2) are mounted, is attached to the carriage 8.

Furthermore, the carriage 8 is provided with a functional liquid feeding mechanism (not shown) that feeds a functional liquid to the ejection heads 50 and with a head driver 48 (see FIG. 5) that performs electrical drive control of the plurality of ejection heads 50.

The moving table 32 moves the carriage 8 in the sub-scanning direction (X-axis direction) and positions the head unit 9 in a position that faces the workpiece W.

Other than the components described above, the ejection device 10 includes a maintenance mechanism that performs maintenance on the plurality of ejection heads 50 mounted in the head unit 9. The maintenance mechanism includes a suction device 70A (see FIG. 4) that removes the clogging of the nozzles and a wiping device 90 (see FIG. 4) that removes foreign matter and dirt from the nozzle surface.

Furthermore, the ejection device 10 includes a weighing device 95 (see FIG. 5) that receives the functional liquid that has been ejected from the nozzle of the ejection head 50 and that measures the weight of the ejected functional liquid, and a monitoring device that can monitor the impact state of the ejected functional liquid. The ejection device 10 further includes a controller 40 that integrally controls these components. Note that in FIG. 1, the maintenance mechanism described above is not shown.

Figure 2A:
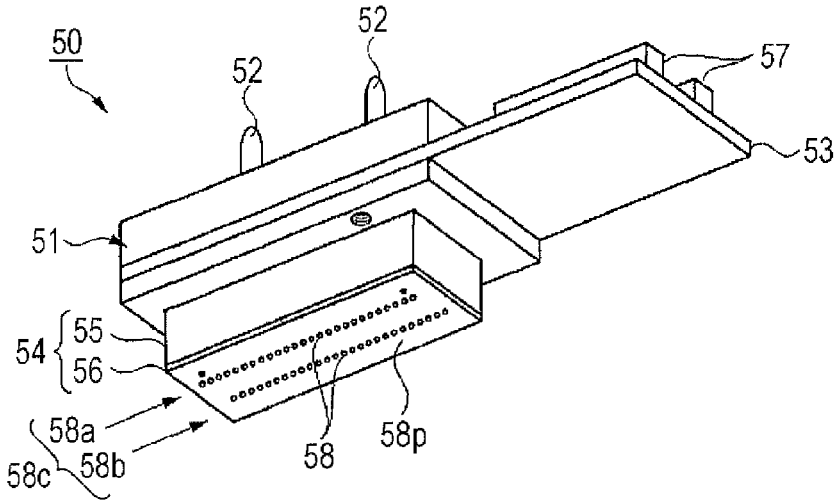
FIG. 2A is a schematic perspective view illustrating a configuration of an ejection head.
Figure 2B:
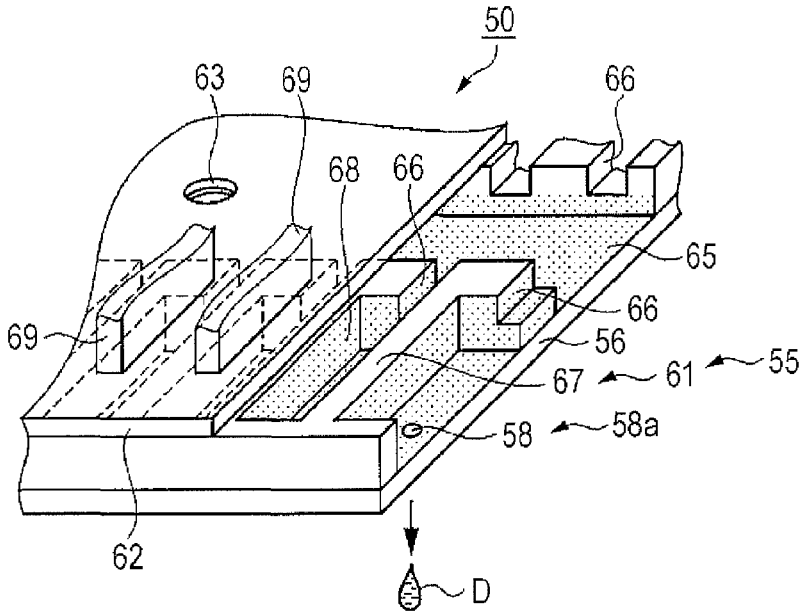
FIG. 2B is a schematic perspective view illustrating a structure of a compression section in the ejection head.
Figure 2C:
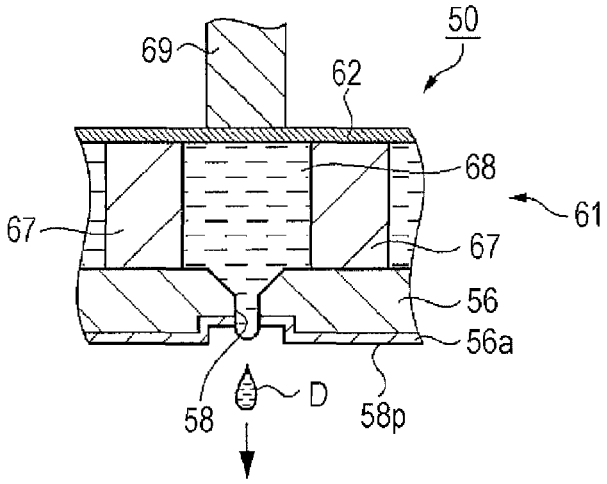
FIG. 2C is a schematic cross-sectional view illustrating a structure of the ejection head provided with a nozzle.

FIG. 2A is a schematic perspective view illustrating a configuration of the ejection head, FIG. 2B is a schematic perspective view illustrating a structure of a compression section in the ejection head, FIG. 2C is a schematic cross-sectional view illustrating a structure of the ejection head provided with a nozzle.

As illustrated in FIG. 2A, the ejection head 50 is so-called a double unit type and includes a functional liquid introduction portion 51 having double connection needles 52, a head substrate 53 on which the introduction portion 51 is stacked, and a head body 54 that is arranged below the head substrate 53 and in which internal flow paths of the functional liquid are formed. The connection needles 52 are connected to the functional liquid feeding mechanism described above through pipes and feed the functional liquid to the internal flow paths. The head substrate 53 is provided with a pair of connectors 57 that are connected to the head driver 48 (see FIG. 5) through a flexible flat cable (not shown).

The head body 54 includes a compression section 55 that is provided with compression chambers that are each constituted by a piezoelectric element serving as a driving device (actuator), and a nozzle plate 56 that is provided with, in a nozzle surface 58*p*, two nozzle rows 58*a* and 58*b* that are aligned parallel to each other.

The two nozzle rows 58*a* and 58*b* are each a row of a plurality of nozzles 58 (180 nozzles) that are spaced substantially evenly apart with each other at a pitch P1. The nozzle rows 58*a* and 58*b* are formed in the nozzle surface 58*p* so that they are offset with each other by a pitch P2 that is half the pitch P1. In the embodiment, the pitch P1 is, for example, about 141 μm. Accordingly, when the ejection head 50 is viewed from a direction that is orthogonal to a nozzle row 58*c*, which is constituted by the two nozzle rows 58*a* and 58*b*, then, 360 nozzles 58 are seen that are aligned with each other with a nozzle pitch of about 70.5 μm. Furthermore, the diameter of each nozzle 58 is about 27 μm.

As illustrated in FIG. 2B, the ejection head 50 includes the nozzle plate 56 provided with the plurality of nozzles 58, a vibrating plate 62, and cavity plates 61 that are arranged between the nozzle plate 56 and the vibrating plate 62.

Each cavity plate 61 constituting the compression section 55 is provided with partition portions 67 that partition each of the plurality of nozzles 58 from each other and a cavity 65 that retains the functional liquid therein. The spaces, which are formed between the nozzle plate 56 and the vibrating plate 62, that are partitioned by the partition portions 67 for each nozzle 58 are compression chambers 68. An orifice (groove) 66 that connects each of the compression chambers 68 and the cavity 65 are formed in each of the partition portions 67. Liquid supply ports 63 that are in communication with the cavity 65 are provided in the vibrating plate 62. The liquid supply ports 63 are connected to the connection needles 52 illustrated in FIG. 2A; accordingly, the cavity 65 and each compression chamber 68 can be filled with the functional liquid. Piezoelectric elements 69, each provided in correspondence with a corresponding compression chamber 68, are provided on the vibrating plate 62. The above-described configuration of the cavity plate 61 is formed in each of the two nozzle rows 58*a* and 58*b* so as to correspond to each of the two nozzle rows 58*a* and 58*b*. Specifically, the compression chambers 68 corresponding to the nozzle row 58*a* and the compression chambers 68 corresponding to the nozzle row 58*b* are arranged with the cavity 65 therebetween.

As shown in FIG. 2C, when a driving signal serving as an electric signal is applied to the piezoelectric elements 69 from the head driver 48, the vibrating plate 62 undergoes deformation and the volumes of the compression chambers 68, which are partitioned by the partition portions 67, change in the ejection head 50. With the pumping action caused by the change in volume of each compression chamber 68, the functional liquid with which each compression chamber 68 has been filled is compressed; accordingly, the functional liquid is ejected from the corresponding nozzles 58 as droplets D. A protective layer 56*a*, on which liquid repellent process has been performed, is formed on the nozzle surface 58*p* of the nozzle plate 56 such that the protective layer 56*a* protects the nozzle surface 58*p* from becoming damaged and, further, prevents the functional liquid from sticking to the nozzle surface 58*p*.

The driving device (actuator) that is provided in each nozzle 58 of the ejection head 50 is not limited to the piezoelectric element 69. The driving device may be an electromechanical conversion element that displaces the vibrating plate 62, serving as an actuator, by electrostatic attraction or may be an electrothermal conversion element that ejects the droplet D from the nozzle 58 after heating the functional liquid.

Figure 3:
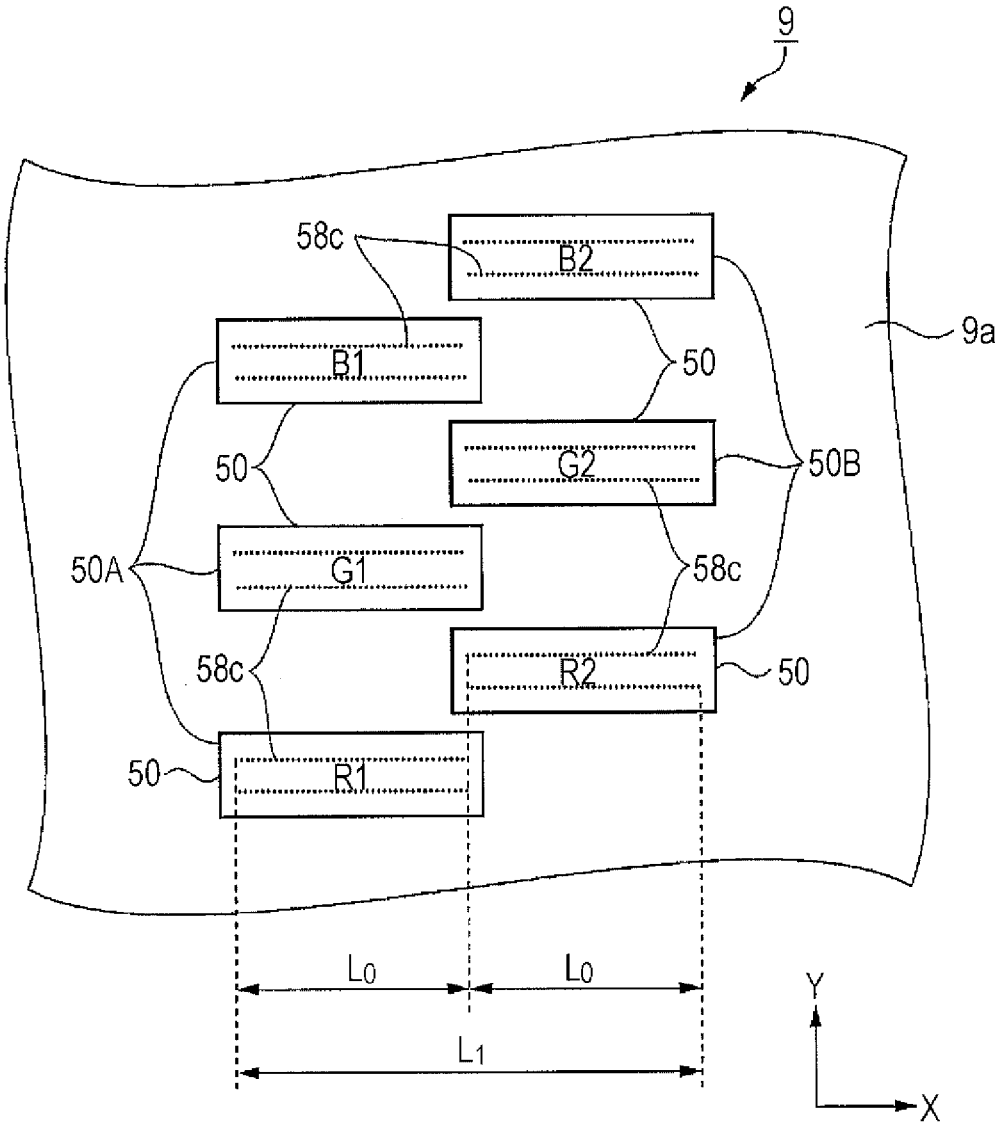
FIG. 3 is a schematic plan view illustrating an arrangement of the ejection heads of the head unit.

FIG. 3 is a schematic plan view illustrating an arrangement of the ejection heads of the head unit. Specifically, FIG. 3 is a diagram viewed from the side that faces the workpiece W.

As illustrated in FIG. 3, the head unit 9 includes the head plate 9*a* in which the plurality of ejection heads 50 are disposed. A total of six ejection heads 50, namely, a group of heads 50A formed of three ejection heads 50 and, likewise, a group of heads 50B formed of three ejection heads 50 are mounted in the head plate 9*a*. In the embodiment, the head R1 (ejection head 50) of the group of heads 50A and the head R2 (ejection head 50) of the group of heads 503 eject the same type of functional liquid. The same applies to the other heads, namely, the head G1 and the head G2, and the head B1 and the head B2. In other words, this configuration allows three different types of functional liquid to be ejected.

The drawing width that can be drawn with a single ejection head 50 is denoted as $L_0$. $L_0$ is the effective length of the nozzle row 58*c*. As described above, the nozzle row 58*c* is constituted by two nozzle rows 58*a* and 58*b*, each of which has 180 nozzles 58. The nozzle row 58*c* is formed of 360 nozzles 58.

The head R1 and the head R2 are disposed parallel to each other in the main scanning direction (Y-axis direction) such that the nozzle rows 58*c* that are adjacent to each other when viewed from the main scanning direction are continuous in the sub-scanning direction (X-axis direction), which is orthogonal to the main scanning direction, with a single nozzle pitch between each other. Accordingly, an effective drawing width $L_1$ of the head R1 and the head R2, which eject the same type of functional liquid, is two times that of the drawing width $L_0$. In a similar manner, the head G1 and the head G2, and the head B1 and the head 32 are arranged parallel to each other in the main scanning direction (Y-axis direction).

Note that the number of nozzle rows 58*c* provided in each ejection head 50 does not have to be two and may be one. Furthermore, the arrangement of the ejection heads 50 in the head unit 9 is not limited to the above-described arrangement.

Figure 4:
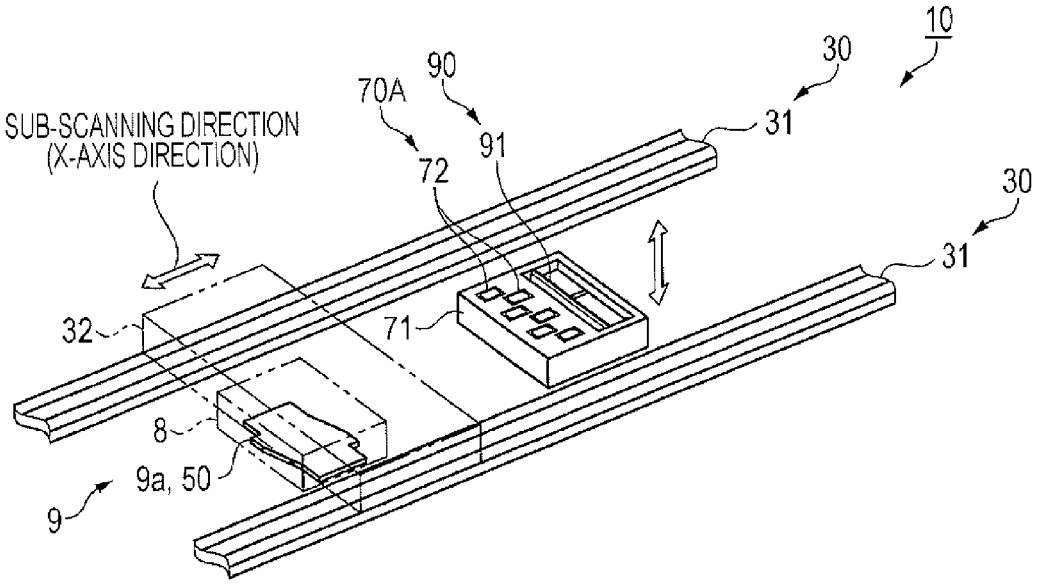
FIG. 4 is a schematic perspective view illustrating a configuration of a suction device and a wiping device.

FIG. 4 is a schematic perspective view illustrating a configuration of the suction device and the wiping device.

As illustrated in FIG. 4, a base 71 is provided between the pair of guide rails 31 of the head moving mechanism 30. The base 71 is provided with a suction device 70A having a plurality of (six) caps 72 and a wiping device 90 that includes a wiping blade 91.

The controller 40 (see FIG. 1) drives and controls the moving table 32 and moves the carriage 8 to a position above the base 71 such that the plurality of (six) ejection heads 50 that are mounted in the head unit 9 can be arranged at a position that faces the plurality of (six) caps 72 or the wiping blade 91. The base 71 includes a moving mechanism (not shown) that moves the base 71 up and down with respect to the ejection head 50.

The detailed configuration of the suction device 70A of the embodiment and the suction method of the embodiment that employs the suction device 70A and the wiping device 90 will be described later.

Figure 5:
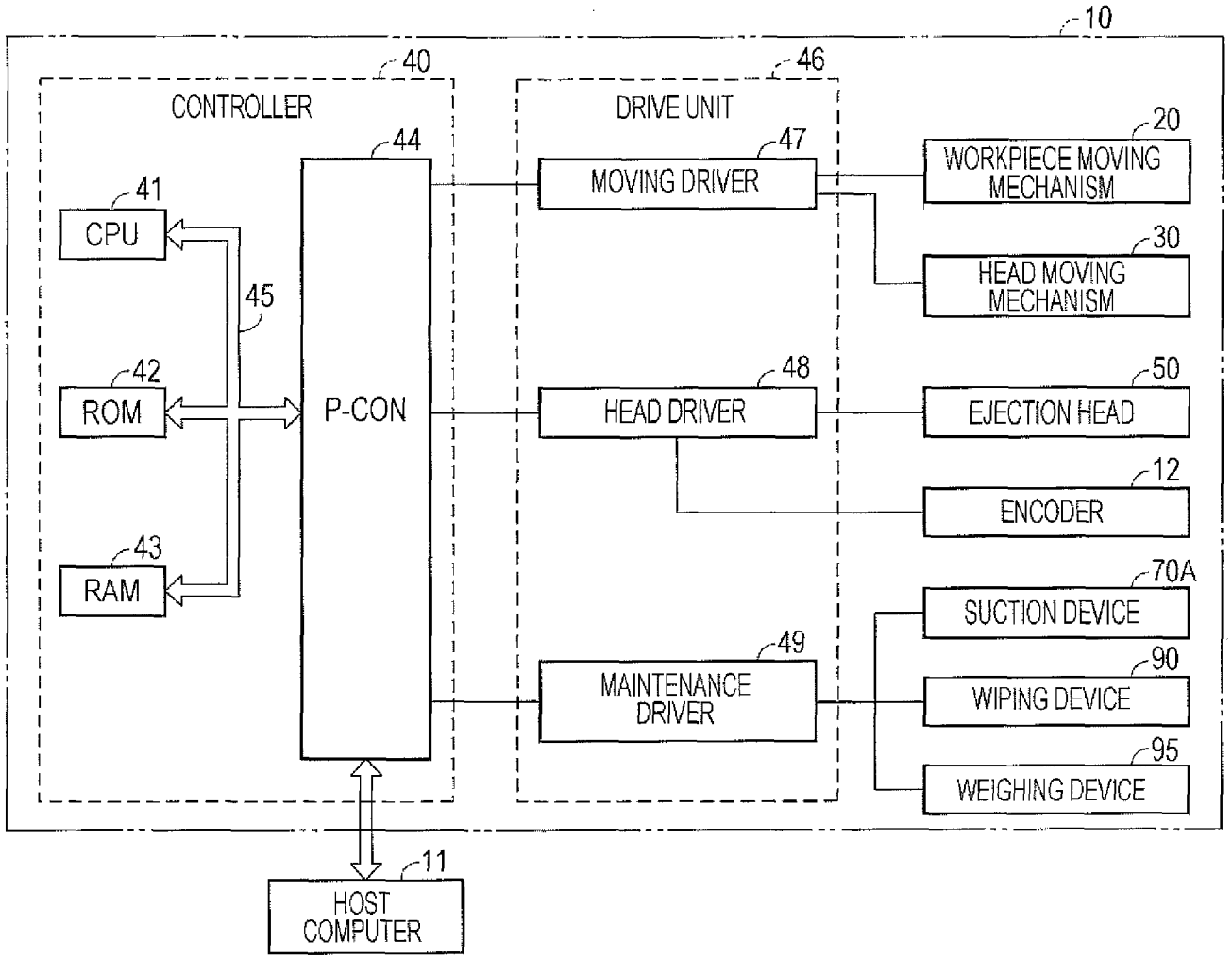
FIG. 5 is a block diagram illustrating a control system of the ejection device of the first embodiment.

A control system of the ejection device 10 will be described with reference to FIG. 5. FIG. 5 is a block diagram illustrating the control system of the ejection device of the first embodiment. As illustrated in FIG. 5, the control system of the ejection device 10 includes a drive unit 46 that has various drivers that drive the ejection heads 50, the workpiece moving mechanism 20, the head moving mechanism 30, and the maintenance mechanism such as the suction device 70A and includes the controller 40 that integrally controls the ejection device 10 including the drive unit 46.

The drive unit 46 includes a moving driver 47 that drives and controls the linear motor of each of the workpiece moving mechanism 20 and the head moving mechanism 30, the head driver 48 that drives and controls the ejection heads 50, and a maintenance driver 49 that drives and controls the maintenance mechanism.

The controller 40 includes a CPU 41, a ROM 42, a RAM 43, and a P-CON 44 that are connected to one another through a bus 45. The P-CON 44 is coupled to a host computer 11. The ROM 42 includes a control program area that stores, for example, a control program that is executed by the CPU 41, and a control data area that stores, for example, control data for performing a drawing operation, a maintenance process of the ejection head 50, and the like.

The RAM 43 includes various storage sections, such as a drawing data storage section that stores drawing data for carrying out drawing onto the workpiece W and a position data storage section that stores position data of the workpiece W and the ejection head 50 (in actuality, the nozzle rows 58*c*). The RAM 43 is used as various work areas for performing the control process. The P-CON 44 is connected to various drivers of the drive unit 46 and complements the functions of the CPU 41. The P-CON 44 is embedded with a logic circuit configured to manage the interface signals with the peripheral circuits. Accordingly, the P-CON 44 takes various commands, which are sent from the host computer 11, to the bus 45 as they are or after processing them. Furthermore, the P-CON 44 works in conjunction with the CPU 41 and outputs the data and control signals, which have been output from the CPU 41 and the like to the bus 45, to the drive unit 46 as they are or after processing them.

Moreover, the CPU 41 inputs, in accordance with the control program stored in the ROM 42, various detection signals, various commands, and various data through the P-CON 44, processes various data in the RAM 43, and outputs various control signals to the drive unit 46 or the like through the P-CON 44; accordingly, the CPU 41 controls the entire ejection device 10. For example, the CPU 41 controls the ejection head 50, workpiece moving mechanism 20, and the head moving mechanism 30 in order to arrange the head unit 9 and the workpiece W so as to face each other. Moreover, the CPU 41 sends out a control signal to the head driver 48 so that the functional liquid is ejected onto the workpiece W as droplets D from the plurality of nozzles 58 of each ejection head 50 mounted in the head unit 9 and so that the ejection is synchronized with the relative movement of the head unit 9 and the workpiece W. In the embodiment, main scanning refers to ejection of the functional liquid while synchronized with the movement of the workpiece W in the Y-axis direction, and sub-scanning refers to moving the head unit 9 in the X-axis direction with respect to the main scanning. The ejection device 10 of the embodiment can eject the functional liquid onto the workpiece W by repeatedly performing a combined movement of the main scanning and the sub-scanning a number of times. The main scanning not only can move the workpiece W in one direction with respect to the ejection head 50 but can also reciprocate the workpiece W.

The encoder 12 is electrically coupled to the head driver 48 and generates an encoder pulse in accordance with the main scanning. The main scanning moves the moving table 22 at a predetermined moving speed; accordingly, an encoder pulse is generated periodically.

For example, assuming that the moving speed of the moving table 22 during the main scanning is 200 mm/sec and the drive frequency at which the ejection head 50 is driven (in other words, the ejection interval when ejecting the droplets D in succession) is 20 kHz, the ejection resolution of the droplet in the main scanning direction is 10 μm since the ejection resolution can be obtained by dividing the moving speed by the drive frequency. In other words, it is possible to arrange the droplets D on the workpiece W at a pitch of 10 μm. The actual ejection interval of the droplets D is based on latch signals generated by counting the encoder pulses that are generated periodically.

The host computer 11 sends out control information, such as the control program and the control data, to the ejection device 10. Furthermore, the host computer 11 has a function of an arrangement information generation unit that generates arrangement information serving as ejection control data that arranges a predetermined amount of functional liquid as droplets D on each ejection area of the workpiece W. The arrangement information is, for example, information, such as the ejection position of the droplets in the ejection area (film formation area), in other words, the relative position between the workpiece W and the nozzle 58; the number of arrangements of the droplet, in other words, the number of ejection per nozzle 58; the on/off of the plurality of nozzles 58 during the main scanning, in other words, selection/non-selection of each nozzle 58; the ejection timings; and the like, which is expressed as a bitmap. The host computer 11 cannot only generate the arrangement information described above but can also modify the arrangement information described above that has been temporarily stored in the RAM 43.

Furthermore, on the basis of a maintenance program stored in the ROM 42, the host computer 11 arranges the ejection heads 50 at a position that faces the suction device 70A and drives the suction device 70A to suck out the functional liquid (liquid), with which the ejection heads 50 have been filled, from the plurality of nozzles 58 of the ejection heads 50. Accordingly, clogging of each of the plurality of nozzles 58 (nozzle row 58*c*) can be eliminated.

Suction Device

Figure 6:
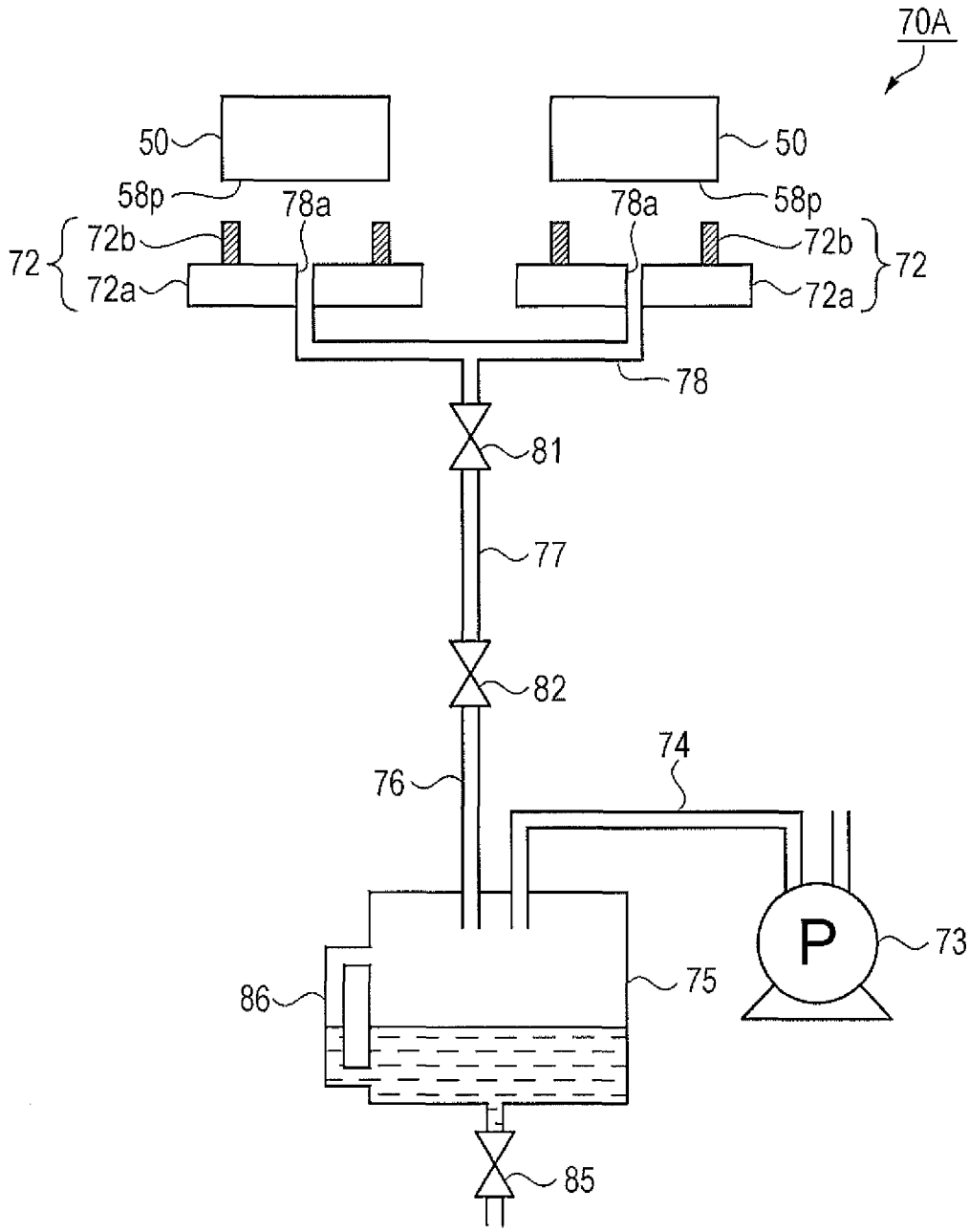
FIG. 6 is a schematic diagram illustrating a configuration of the suction device of the first embodiment.
Figure 7:
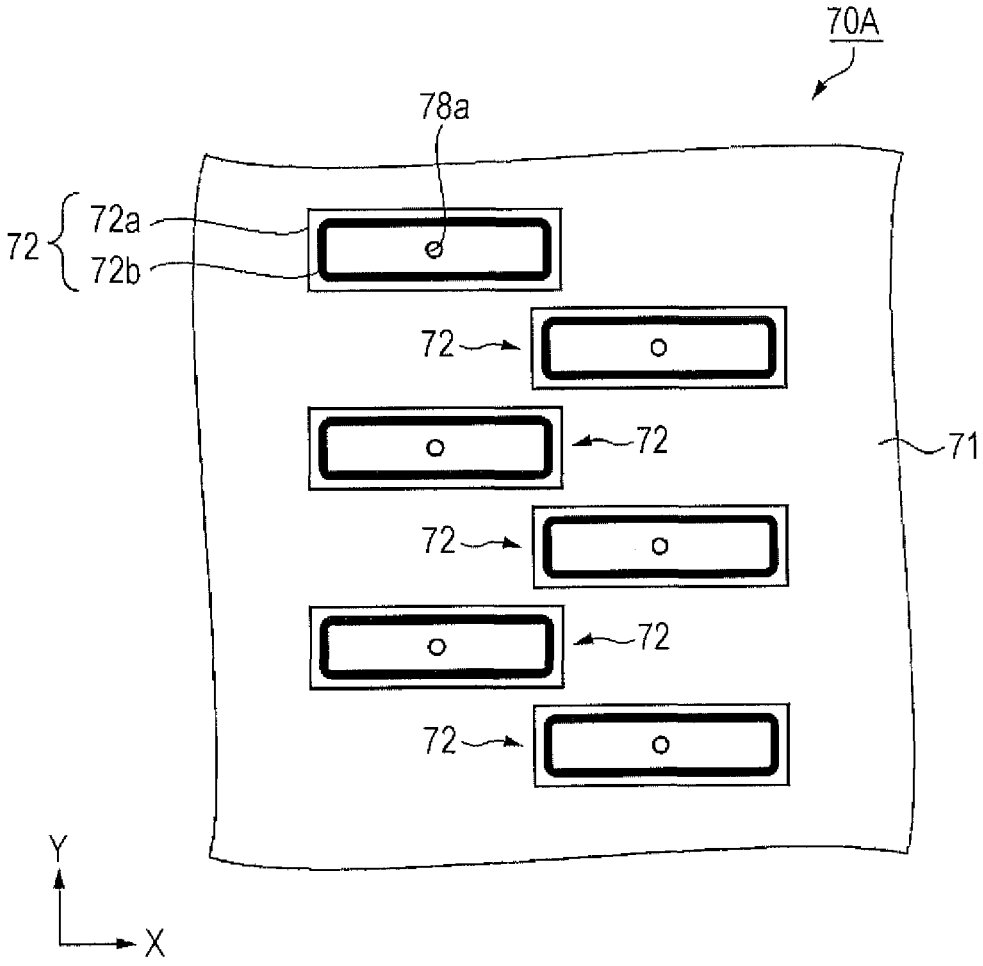
FIG. 7 is a schematic plan view illustrating an arrangement of caps of the suction device of the first embodiment.

The suction device 70A of the embodiment will be described next with reference to FIGS. 6 and 7. FIG. 6 is a schematic diagram illustrating a configuration of the suction device of the first embodiment, and FIG. 7 is a schematic plan view illustrating an arrangement of caps of the suction device of the first embodiment.

As illustrated in FIG. 6, the suction device 70A of the embodiment includes caps 72 that are capable of sealing the nozzle surfaces 58*p* of the ejection heads 50, a decompression pump 73 serving as a decompression device, a suction passage 77 provided between the caps 72 and the decompression pump 73, and a liquid reservoir 75 provided between the suction passage 77 and the decompression pump 73. A first on-off valve 81 is provided in the suction passage 77 on the cap 72 side thereof and a second on-off valve 82 is provided in the suction passage 77 on the decompression pump 73 side thereof. The first on-off valve 81 and the second on-off valve 82 are preferably electromagnetic valves that are capable of electrically controlling the on and off state thereof.

The suction passage 77 may be any component whose volume can be determined by closing the first on-off valve 81 and the second on-off valve 82 and may be, for example, a composite valve that is a rigid pipe, the first on-off valve 81, and the second on-off valve 82 combined into a single component.

Furthermore, a plurality of rigid pipes may be combined in a telescoping manner while maintaining airtightness such that the structure allows the volume of the suction passage 77 to be changed when the first on-off valve 81 and the second on-off valve 82 are closed, for example.

In the embodiment, two caps 72 corresponding to two ejection heads 50 that eject the same type of functional liquid (liquid) are connected to a single suction passage 77 through a bifurcated suction passage 78. The suction passage 78 may be formed inside the base 71 described above or may be a pipe provided in the base 71.

The liquid reservoir 75 is an airtight container in which the functional liquid that has been sucked out from the ejection head 50 is temporarily retained. A pipe 74 that connects the decompression pump 73 and the liquid reservoir 75 is provided on the upper surface side of the liquid reservoir 75. Similarly, a pipe 76 that connects the second on-off valve 82 of the suction passage 77 and the liquid reservoir 75 is provided. A drain valve 85 that discharges the retained functional liquid is provided on the bottom surface side of the liquid reservoir 75. A pipe 86 that connects the upper surface side and the bottom surface side of the liquid reservoir 75 is provided on the lateral surface of the liquid reservoir 75. A transparent glass tube, for example, is employed in the portion of the pipe 86 that extends along the lateral surface of the liquid reservoir 75; accordingly, the liquid level of the functional liquid retained in the liquid reservoir 75 can be observed.

Each cap 72 includes a cap base 72*a* to which the suction passage 78 is connected and a cap section 72*b* that is arranged on the cap base 72*a* and that comes into contact with the nozzle surface 58*p* of the ejection head 50. An elastic member is employed as the cap section 72*b* so that the nozzle surface 58*p* can be sealed when the cap section 72*b* comes into contact with the nozzle surface 58*p*. The elastic member may include, for example, fluororubber that is excellent in chemical resistance.

As illustrated in FIG. 7, a plurality of (six) caps 72 that correspond to the group of heads 50A and 50B arranged on the head plate 9*a* (see FIG. 3) are arranged on the base 71. The cap section 72*b* is shaped like a running track and is provided around a hole 78*a* provided in the cap base 72*a*.

The decompression pump 73 serving as a decompression device may be, for example, a rotary vacuum pump or an ejector that uses compressed air.

In the embodiment, the ejection device 10 is configured so as to be capable of ejecting three types of functional liquids, and two ejection heads 50 are attached to the head plate 9*a* for each functional liquid. Accordingly, the suction device 70A includes at least three suction passages 77 that correspond to the types of the functional liquids. A liquid reservoir 75 and a decompression pump 73 serving as a decompression device may be provided to each suction passage 77 that corresponds to a particular type of functional liquid. Alternatively, a single set of liquid reservoir 75 and decompression pump 73 may be provided to the at least three suction passages 77 that correspond to the three types of functional liquids.

Other than the configuration described above, the suction device 70A includes a manometer (not shown) that is capable of electrically detecting the pressure inside the liquid reservoir 75. Furthermore, the suction device 70A may further include a measuring instrument that measures the weight or the volume of the functional liquid that is discharged when the functional liquid retained in the liquid reservoir 75 is discharged by opening the drain valve 85.

Suction Method

Figure 8:
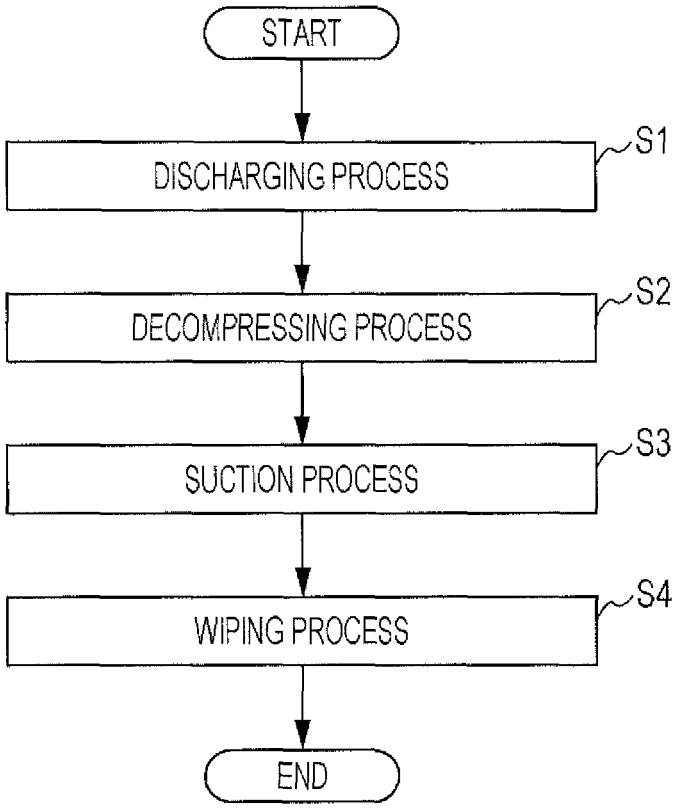
FIG. 8 is a flow chart illustrating a suction method of the first embodiment.
Figure 9:
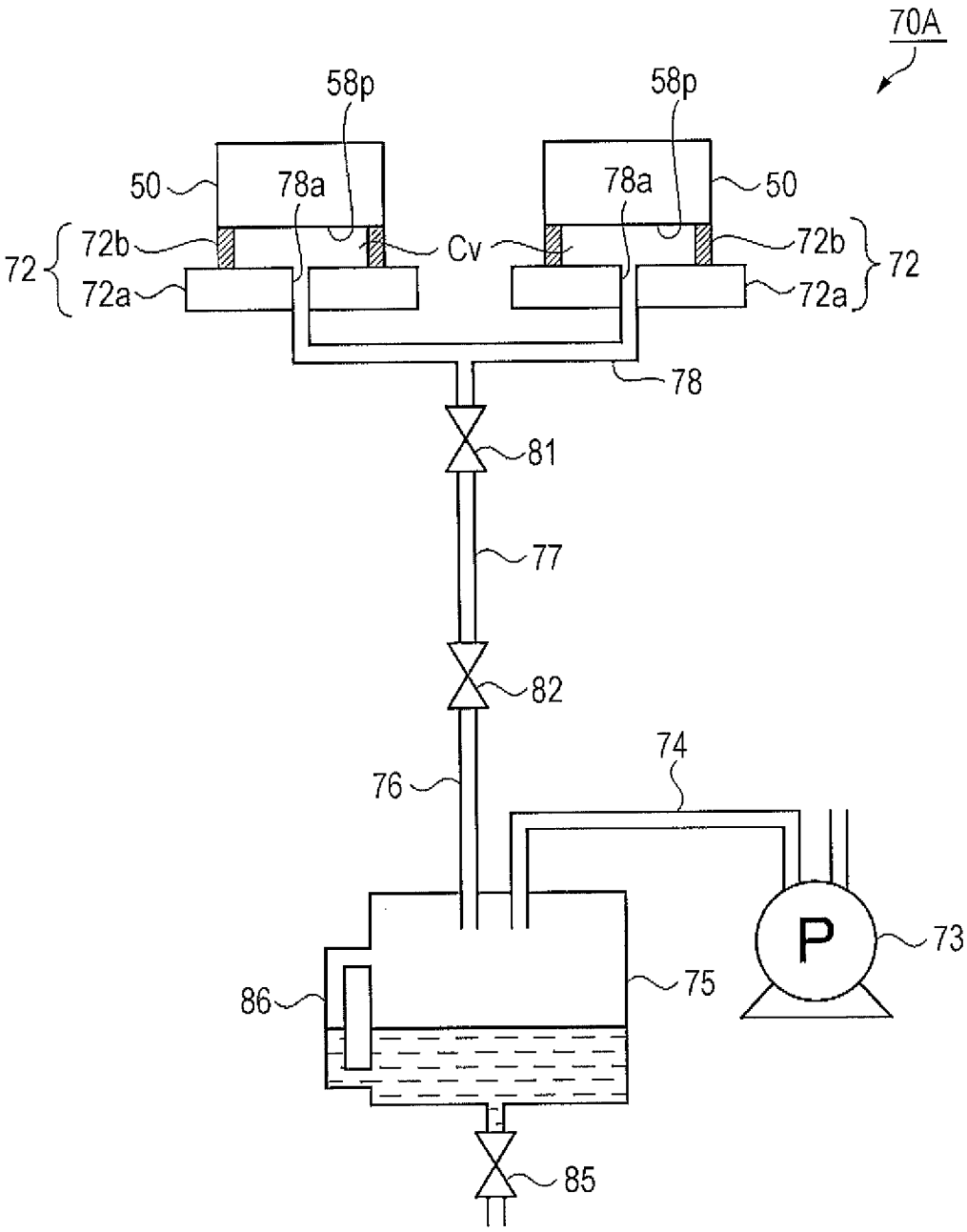
FIG. 9 is a schematic diagram illustrating a suction process carried out by the suction device.

The suction method of the embodiment will be described below with reference to FIGS. 8 and 9. FIG. 8 is a flow chart illustrating the suction method of the first embodiment and FIG. 9 is a schematic diagram illustrating a suction process carried out by the suction device.

As illustrated in FIG. 8, the suction method using the suction device 70A of the embodiment includes a discharging process (step S1), a decompressing process (step S2), a suction process (step S3), and a wiping process (step S4).

In the discharging process (step S1) of FIG. 8, the functional liquid remaining in the suction passage 77 is discharged. Specifically, the controller 40 controls the suction device 70A such that, as illustrated in FIG. 6, while each cap 72 is detached from the nozzle surface 58*p* of the corresponding ejection head 50, the first on-off valve 81 and the second on-off valve 82 are opened and the decompression pump 73 is driven so that the liquid reservoir 75 is decompressed inside. Accordingly, the functional liquid remaining in the suction passages 77 and 78 and the pipe 76 that are in communication with the caps 72 is sucked into and contained in the liquid reservoir 75 together with the atmosphere. This discharges at least the functional liquid remaining in the suction passage 77. The decompression pump 73 is stopped. Next, the process proceeds to step S2.

In the decompressing process (step S2) of FIG. 8, the suction passage 77 is decompressed so as to reach a predetermined negative pressure level. Specifically, as illustrated in FIG. 6, while each cap 72 is detached from the nozzle surface 58*p* of the corresponding ejection head 50, the first on-off valve 81 is closed, the second on-off valve 82 is opened, and the decompression pump 73 is driven so that the liquid reservoir 75 is decompressed inside. The second on-off valve 82 is closed after the suction passage 77 that is in communication with the liquid reservoir 75 is decompressed to a predetermined negative pressure level. The decompression pump 73 is stopped. Next, the process proceeds to step S3.

In the suction process (step S3) of FIG. 8, first, the base 71 is raised, and, as illustrated in FIG. 9, each cap 72 is pressed against the nozzle surface 58*p* of the corresponding ejection head 50 such that the nozzle surfaces 58*p* are sealed with the caps 72. Next, the first on-off valve 81 is opened and spaces Cv that are sealed off by the caps 72 are decompressed by use of the negative pressure of the suction passage 77. Accordingly, the functional liquid with which the ejection heads 50 has been filled is sucked out from the plurality of nozzles 58 (nozzle row 58*c*). Since the supply passage of the functional liquid to the ejection heads 50 is not closed, the above-described suction operation is carried out until the pressure (negative pressure state) in the suction passage 77 becomes substantially equivalent to the pressure of the surrounding environment. When the functional liquid is sucked out from the plurality of nozzles 58 (nozzle row 58*c*), foreign matter, which are dried and solidified functional liquid, and bubbles, for example, are sucked out and removed from the clogged nozzle 58 at the same time. Next, the process proceeds to step S4.

The wiping process (step S4) of FIG. 8 is a process that wipes off the functional liquid and the foreign matter, which have stuck to the nozzle surfaces 58*p* during the suction process, by use of the wiping device 90. Specifically, when the suction process is ended, the base 71 is lowered and the caps 72 are detached from the nozzle surfaces 58*p* of the ejection heads 50. Next, the head moving mechanism 30 moves the moving table 32 so that the head unit 9 is arranged at a position facing the wiping device 90 (see FIG. 4). The base 71 is raised and the wiping blade 91 is abutted against one end of the nozzle surfaces 58*p* of the ejection heads 50 in the longitudinal direction. Then, while the wiping blade 91 is abutted against the nozzle surfaces 58*p*, the wiping blade 91 is moved from one end of the nozzle surfaces 58*p* in the longitudinal direction to the other end thereof; accordingly, the wiping blade 91 wipes the nozzle surfaces 58*p*. Accordingly, the functional liquid and foreign matter that have stuck to the nozzle surfaces 58*p* is scraped off with the wiping blade 91, and the nozzle surfaces 58*p* are cleaned.

In the suction process described above, a suction volume V of the suction operation that uses the negative pressure of the suction passage 77 is a product of a volume V0 of the suction passage 77 and a negative pressure level Vp of the suction passage 77.

For example, assuming that the negative pressure level Vp is −60 kPa when the volume V0 of the suction passage 77 is 1 $cm^3$ (cc) and the atmospheric pressure is 0 kPa, the suction volume V will be 0.6 $cm^3$ (cc). The −60 kPa indicated as the negative pressure level Vp is gauge pressure. When the absolute vacuum is zero kPa, then, one atmospheric pressure is about 100 kPa; accordingly, by setting the negative pressure level Vp to, for example, −60 kPa, 60% of the volume V0 of the suction passage 77 can be sucked out.

In other words, since the volume V0 of the suction passage 77 between the first on-off valve 81 and the second on-off valve 82 is constant, the suction volume V can be accurately set by controlling the negative pressure level Vp (gauge pressure) of the suction passage 77. A negative pressure level Vp can be assigned to change the suction volume V; accordingly, it will be possible to know the volume of the functional liquid that can be sucked out from the ejection head 50 with the suction volume V. Furthermore, by examining the relationship between the suction volume V and the degree of elimination of the nozzle clogging, the minimum suction volume V that can eliminate the nozzle clogging can be derived, in other words, the minimum volume of the functional liquid that is sucked out from the ejection head 50 by the suction device 70A can be derived.

In the embodiment, the volume of the ejection head 50 from the liquid supply port 63 to the plurality of (360) nozzles 58 including the cavity 65 is approximately 0.6 $cm^3$ (cc). In the suction device 70A of the embodiment that can carry out suction of the two ejection heads 50 at the same time, the volume V0 of the suction passage 77 is set to 2 $cm^3$ (cc) and the negative pressure level Vp is set to −60 kPa; accordingly, the suction volume V is 1.2 $cm^3$ (cc). With the above-described configuration, approximately 0.6 $cm^3$ (cc) of the functional liquid can be sucked out from each of the ejection heads 50. Furthermore, it has been found out that when the suction volume V is set to a value less than 1.2 $cm^3$ (cc), the functional liquid that is sucked out decreases making it difficult to eliminate clogging of the nozzles, and that clogging of the nozzles can be substantially eliminated by setting the suction volume V to 1.2 $cm^3$ (cc) or more. That is to say, clogging of the nozzles is eliminated if 0.6 $cm^3$ (cc) of the functional liquid can be sucked out from the plurality of nozzles 58 of the ejection head 50.

Note that a functional liquid including a light-emitting layer forming material for an organic electroluminescence element is used in the embodiment. The light-emitting layer forming material contains a host material and a luminescent material serving as a dopant, and the content of the light-emitting layer forming material is approximately 0.5 wt % to approximately 1.0 wt %. The solvent may include cyclohexylbenzene. The functional liquid described above, which contains the light-emitting layer forming material and the solvent, is in a low viscosity state (30 Pa·s (Pascal second) or lower, for example) that facilitates the functional liquid to be ejected as droplets D from the nozzles 58 of the ejection head 50.

The minimum quantity of the functional liquid, which is sucked out by the suction device 70A, capable of eliminating the nozzle clogging is affected by the physical properties of the functional liquid, such as, for example, the viscosity and the interfacial tension. Accordingly, the suction volume V, in other words, the volume V0 of the suction passage 77 and the negative pressure level Vp, is preferably adjusted in accordance with the type of functional liquid.

Furthermore, in the embodiment, the suction process (suction operation) is carried out after the decompressing process that sets the suction passage 77 to a predetermined negative pressure level Vp. Accordingly, compared with a case in which, after opening the first on-off valve 81 and the second on-off valve 82, the decompression pump 73 is driven and the decompressing process and the suction process are performed at the same time, for example, the spaces Cv, which are formed when the caps 72 seal the nozzle surfaces 58*p*, can be exposed to the negative pressure state of the suction passage 77 more quickly. Since the suction volume V of the suction device 70A is affected by the spaces Cv described above and the volume of the suction passage 78, between the first on-off valve 81 and the cap base 72*a*, that is in communication with the space Cv described above, it is preferable that the sum of the volume of the two spaces Cv described above and the volume of the suction passage 78 added together is smaller than the volume of the suction passage 77. In other words, the volume of the suction passage 77 is preferably larger than the sum of the volume of the plurality of (two) spaces Cv described above and the volume of the suction passage 78 added together. Accordingly, the spaces Cv can be made to quickly reach the negative pressure state.

The following effects can be obtained by the first embodiment described above.

(1) The suction device 70A and the suction method employing the suction device 70A include the caps 72 that can seal the nozzle surfaces 58*p* of the ejection heads 50, the decompression pump 73 serving as a decompression device, the suction passage 77 provided between the caps 72 and the decompression pump 73, the first on-off valve 81 provided in the suction passage 77 on the caps 72 side thereof, and the second on-off valve 82 provided in the suction passage 77 on the decompression pump 73 side thereof. The first on-off valve 81 is closed and the second on-off valve 82 is opened, and the suction passage 77 is brought to a predetermined negative pressure level Vp by the decompression pump 73. Subsequently, the nozzle surfaces 58*p* of the ejection heads 50 are sealed with the caps 72, the second on-off valve 82 is closed and the first on-off valve 81 is opened, and the functional liquid, with which the ejection heads 50 has been filled, is sucked out from the plurality of nozzles 58 by use of the negative pressure level Vp of the suction passage 77. The suction volume V of the suction device 70A and the suction method employing the suction device 70A is a product of the volume V0 of the suction passage 77 and the negative pressure level Vp, accordingly, the suction volume V is set by controlling the negative pressure level Vp.

Compared to the case in which the decompression pump 73 carries out continuous suction and sucks out the filled functional liquid from the ejection heads 50, the suction volume V can be accurately set and, further, excessive suction of the functional liquid from the ejection heads 50 can be reduced. In other words, the suction device 70A and the suction method employing the suction device 70A that can eliminate clogging of the nozzles 58 and that can prevent the functional liquid from being wastefully used by the suction operation can be provided.

(2) The suction device 70A includes the plurality of (two) caps 72 that correspond to the plurality of (two) ejection heads 50 that eject the same type of functional liquid, and the plurality of (two) caps 72 is connected to the single suction passage 77 through the first on-off valve 81. In other words, suction can be carried out for each type of functional liquid. While there is a possibility that the suction condition for eliminating the clogging of the nozzles 58 may change depending on the type of functional liquid, the embodiment allows an optimum suction operation to be carried out for each type of functional liquid.

(3) In the suction method of the first embodiment described above, the discharging process that discharges the functional liquid remaining in the suction passage 77 into the liquid reservoir 75 is carried out before decompressing the suction passage 77; accordingly, during the decompressing process, the suction passage 77 can be consistently brought to a predetermined negative pressure level Vp without being influenced by the remaining functional liquid. In other words, the desired suction volume V can be secured and the clogging of the nozzles 58 can be eliminated in a consistent manner.

(4) The ejection device 10 includes the suction device 70A; accordingly, wasting of the functional liquid by the suction operation is suppressed and clogging of the nozzles 58 of each of the ejection heads 50, which is provided for each type of functional liquid, can be eliminated. Accordingly, the ejection heads 50 can achieve stable ejection of the functional liquids. Therefore, the functional liquid is ejected onto the ejection area of the workpiece W, which is an object to be ejected, in a stable manner; accordingly, an ejection device 10 that is capable of uniformly forming a functional film that is formed of a functional material can be provided.

Second Embodiment

Figure 10:
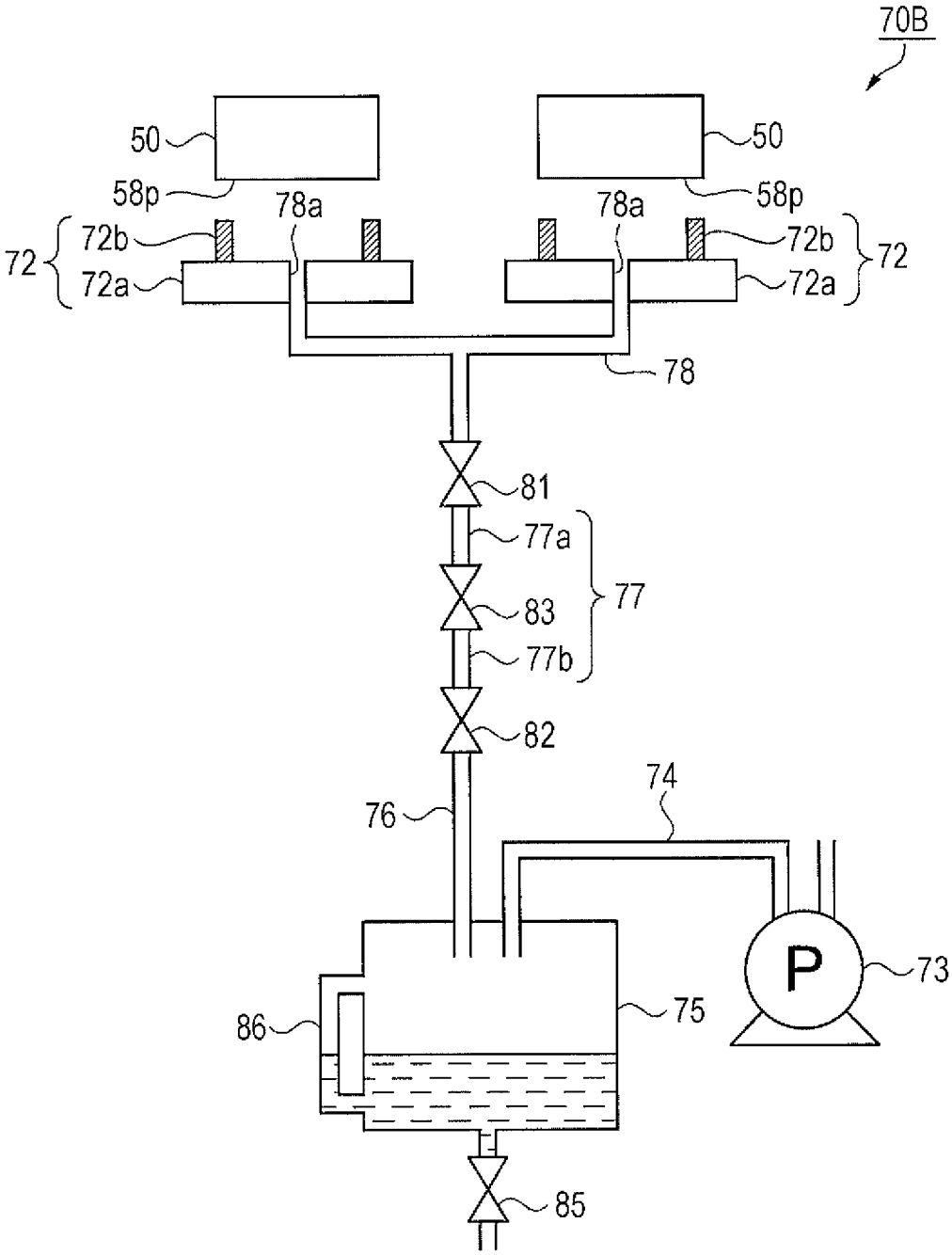
FIG. 10 is a schematic diagram illustrating a configuration of a suction device of a second embodiment.

A suction device of a second embodiment and a suction method thereof will be described next with reference to FIG. 10. FIG. 10 is a schematic diagram illustrating a configuration of a suction device of the second embodiment. The suction device of the second embodiment is different from the first embodiment in that the configuration of the suction passage 77 is different from that of the suction device 70A. Accordingly, elements that are the same as those of the first embodiment are denoted with the same reference numerals and the detailed descriptions thereof are omitted.

As illustrated in FIG. 10, a suction device 70B of the second embodiment includes the caps 72 that are capable of sealing the nozzle surfaces 58*p* of the ejection heads 50, the decompression pump 73 serving as a decompression device, the suction passage 77 provided between the caps 72 and the decompression pump 73, the liquid reservoir 75 provided between the suction passage 77 and the decompression pump 73. The suction passage 77 includes a first suction passage 77*a* and a second suction passage 77*b* that are connected in series. The first on-off valve 81 is provided in the first suction passage 77*a* on the cap 72 side thereof, the second on-off valve 82 is provided in the second suction passage 77*b* on the decompression pump 73 side thereof, and a third on-off valve 83 is provided between the first suction passage 77*a* and the second suction passage 77*b*.

The volume of the first suction passage 77*a* and the volume of the second suction passage 77*b* may be the same or may be different.

The suction method using such a suction device 70B performs basically the same processes (see FIG. 8) as that of the suction method using the suction device 70A of the first embodiment described above; however, the decompressing process and the suction process are partially different.

In the decompressing process (step S2), the first on-off valve 81 is closed, the second on-off valve 82 and the third on-off valve 83 are opened, and the first suction passage 77*a* and the second suction passage 77*b* are both decompressed until a predetermined negative pressure level Vp is reached. Then, the second on-off valve 82 and the third on-off valve 83 are closed. The decompression pump 73 is stopped.

In the suction process (step S3), the nozzle surfaces 58*p* of the ejection heads 50 are sealed with the caps 72. In this state, the first on-off valve 81 is opened and a suction operation using the negative pressure of the first suction passage 77*a* is carried out (a first suction process). After the first suction process is completed, the pressure inside each of the caps 72 will be the same as that of the surrounding environment. Next, the third on-off valve 83 is opened and a suction operation using the negative pressure of the second suction passage 77*b* is carried out (second suction process).

The suction device 70B of the second embodiment and the suction method using the suction device 70B can obtain the following effect in addition to the effects (1) to (4) of the first embodiment.

(5) The suction passage 77 is separated into the first suction passage 77*a* and the second suction passage 77*b*; accordingly, sucking can be carried out in a stepwise manner by the first suction process having a suction volume V1 that is a product of the volume of the first suction passage 77*a* and the negative pressure level Vp and by the second suction process having a suction volume V2 that is a product of the volume of the second suction passage 77*b* and the negative pressure level Vp.

When the volume of the first suction passage 77*a* and the volume of the second suction passage 77*b* are the same, sucking can be carried out in a stepwise manner in two steps with the same suction volume.

Furthermore, when the volume of the first suction passage 77*a* and the volume of the second suction passage 77*b* are different, sucking can be carried out in a stepwise manner in two steps with different suction volumes.

Compared to a case in which the desired suction volume V is sucked with a single suction operation, since the suction operation is carried out in steps, excessive suction of the functional liquid can be suppressed.

Third Embodiment

Figure 11:
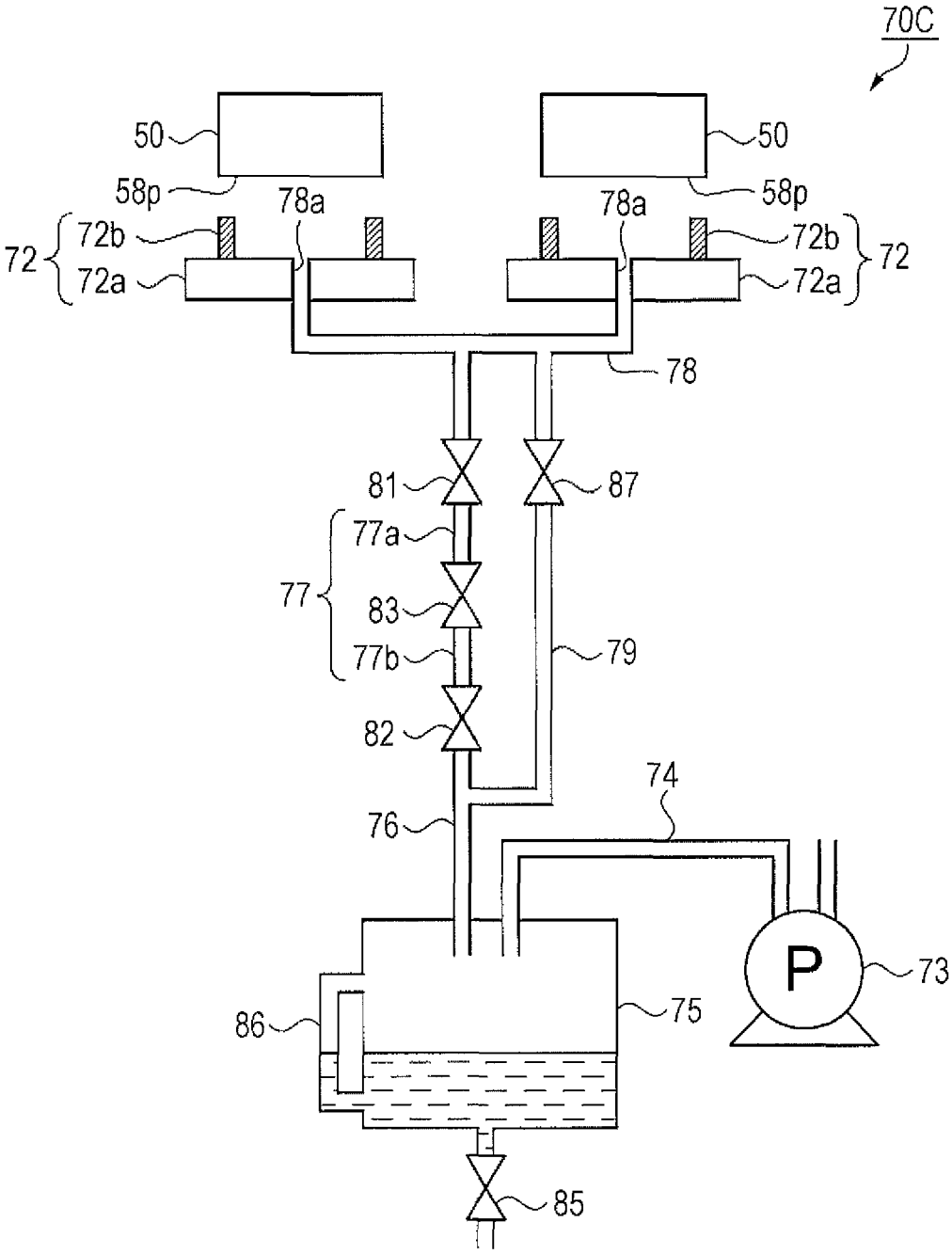
FIG. 11 is a schematic diagram illustrating a configuration of a suction device of a third embodiment.

A suction device of a third embodiment and a suction method thereof will be described next with reference to FIG. 11. FIG. 11 is a schematic diagram illustrating a configuration of a suction device of the third embodiment. The suction device of the third embodiment is the suction device 70B of the second embodiment added with a suction bypass passage. Accordingly, elements that are the same as those of the second embodiment are denoted with the same reference numerals and the detailed description thereof is omitted.

As illustrated in FIG. 11, a suction device 70C of the third embodiment includes the caps 72 that are capable of sealing the nozzle surfaces 58*p* of the ejection heads 50, the decompression pump 73 serving as a decompression device, the suction passage 77 provided between the caps 72 and the decompression pump 73, and a suction bypass passage 79 that is provided in parallel with the suction passage 77. The suction device 70C further includes the liquid reservoir 75 provided between the decompression pump 73, each of the suction passage 77, and the suction bypass passage 79. The suction passage 77 includes the first suction passage 77*a* and the second suction passage 77*b* that are connected in series. The first on-off valve 81 is provided in the first suction passage 77*a* on the cap 72 side thereof, the second on-off valve 82 is provided in the second suction passage 77*b* on the decompression pump 73 side thereof, and the third on-off valve 83 is provided between the first suction passage 77*a* and the second suction passage 77*b*. A fourth on-off valve 87 is provided in the suction bypass passage 79 on the caps 72 side thereof. The first on-off valve 81 and the fourth on-off valve 87 are each connected to the suction passage 78 that is in communication with the two caps 72.

The decompression pump 73 side of the suction bypass passage 79 is connected to the pipe 76 between the second on-off valve 82 and the liquid reservoir 75.

The volume of the first suction passage 77*a* and the volume of the second suction passage 77*b* may be the same or may be different.

The suction method using such a suction device 70C performs basically the same processes (see FIG. 8) as that of the suction method using the suction device 70A of the first embodiment described above; however, the decompressing process and the suction process are partially different.

In the decompressing process (step S2), the first on-off valve 81 and the fourth on-off valve 87 are closed, the second on-off valve 82 and the third on-off valve 83 are opened, and the suction passage 77 is decompressed therein until a predetermined negative pressure level Vp is reached. Then, the second on-off valve 82 and the third on-off valve 83 are closed. The decompression pump 73 is stopped.

In the suction process (step S3), while the nozzle surfaces 58*p* of the ejection heads 50 are sealed with the caps 72, the first on-off valve 81 is opened and the suction operation using the negative pressure of the first suction passage 77*a* is carried out (the first suction process). After the first suction process is completed, the pressure inside each of the caps 72 will be the same as that of the surrounding environment. Next, the third on-off valve 83 is opened and a suction operation using the negative pressure of the second suction passage 77*b* is carried out (second suction process).

Furthermore, the first on-off valve 81 may be closed, the fourth on-off valve 87 may be opened, the decompression pump 73 may be driven, such that a third suction process that performs a continuous suction operation through the suction bypass passage 79 is carried out in accordance with the clogging state of the nozzles 58.

The order of when the third suction process is performed is not limited to after the second suction process, and the third suction process may be performed alone. Alternatively, the third suction process may be performed before the first suction process.

The suction device 70C of the third embodiment and the suction method using the suction device 70C can obtain the following effect in addition to the effects (1) to (4) of the first embodiment and the effect (5) of the second embodiment.

(6) The first to third suction process can be selectively used in accordance with the clogging state of the nozzles 58. The suction bypass passage 79 can be decompressed at the same time as the decompression of the first suction passage 77*a* and the second suction passage 77*b* that are decompressed into a negative pressure state; accordingly, switching from the second suction process to the third suction process or switching from the third suction process to the first suction process can be carried out quickly.

Fourth Embodiment

Figure 12:
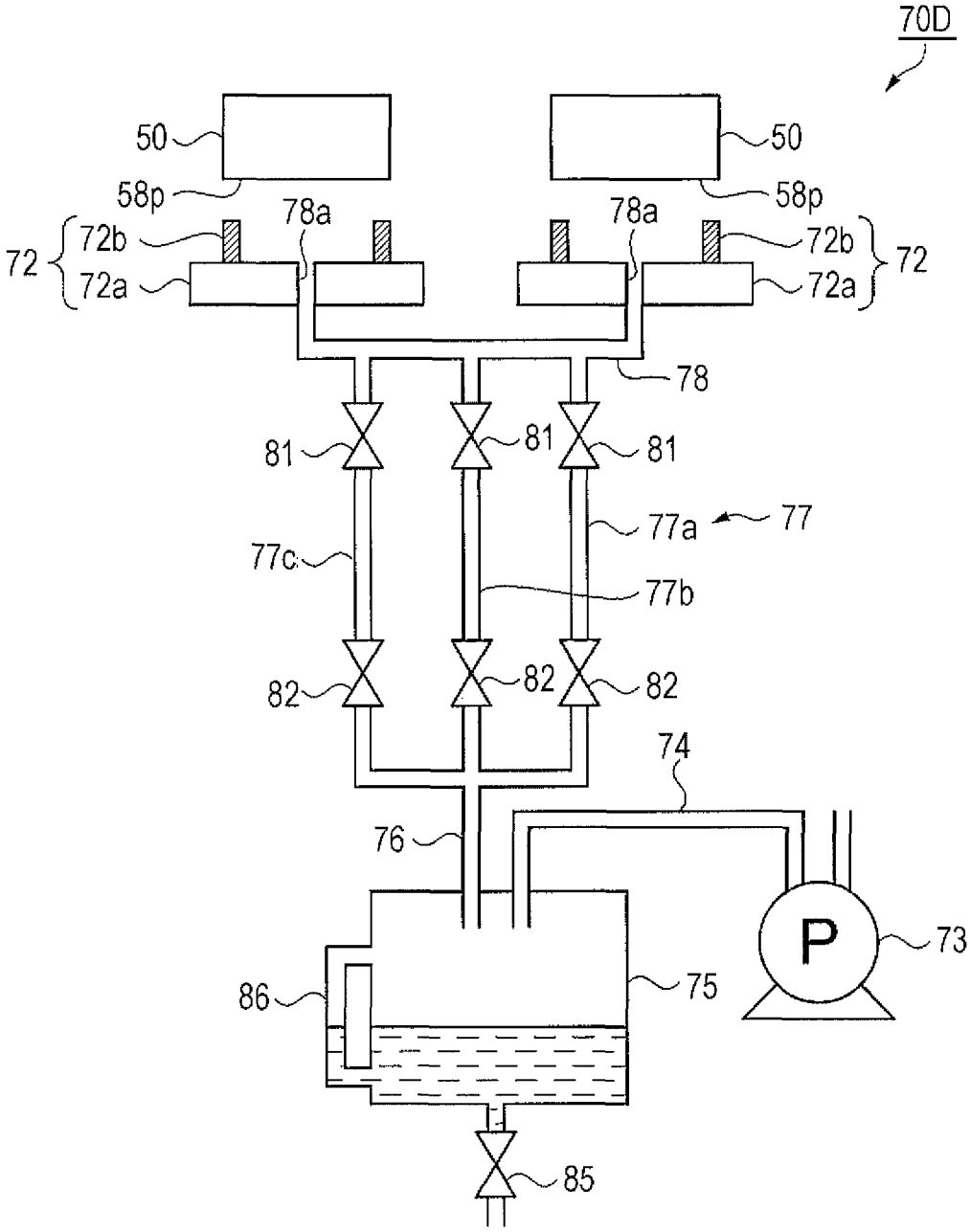
FIG. 12 is a schematic diagram illustrating a configuration of a suction device of a fourth embodiment.

A suction device of a fourth embodiment and a suction method thereof will be described next with reference to FIG. 12. FIG. 12 is a schematic diagram illustrating a configuration of the suction device of the fourth embodiment. The suction device of the fourth embodiment has a different configuration of the suction passage with respect to that of the suction device 70A of the first embodiment. Accordingly, elements that are the same as those of the first embodiment are denoted with the same reference numerals and the detailed descriptions thereof are omitted.

As illustrated in FIG. 12, a suction device 70D of the fourth embodiment includes the caps 72 that can seal the nozzle surfaces 58*p* of the ejection heads 50, the decompression pump 73 serving as a decompression device, and suction passages 77 provided between the caps 72 and the decompression pump 73. The suction device 70D further includes the liquid reservoir 75 provided between the suction passages 77 and the decompression pump 73. The suction passage 77 include the first suction passage 77*a*, the second suction passage 77*b*, and a third suction passage 77*c* that are connected in parallel. A first on-off valve 81 is provided in each of the first suction passage 77*a*, the second suction passage 77*b*, and the third suction passage 77*c* on their caps 72 side and a second on-off valve 82 is provided in each of the first suction passage 77*a*, the second suction passage 77*b*, and the third suction passage 77*c* on their decompression pump 73 side. Each of the three first on-off valves 81 are connected to the suction passage 78 that is in communication with the two caps 72. Each of the three second on-off valves 82 are connected to the pipe 76 that is a pipe between the second on-off valves 82 and the liquid reservoir 75.

The volume of the first suction passage 77*a*, the volume of the second suction passage 77*b*, and the volume of the third suction passage 77*c* may be the same or may be different. The volume of a suction passage among the three suction passages 77*a*, 77*b*, and 77*c* may be different from the volume of the other suction passages.

The suction method using such a suction device 70D performs basically the same processes (see FIG. 8) as that of the suction method using the suction device 70A of the first embodiment described above; however, the decompressing process and the suction process are partially different.

In the decompressing process (step S2), the three first on-off valves 81 are closed, the three second on-off valves 82 are opened, and the three suction passages 77*a*, 77*b*, and 77*c* are each decompressed until a predetermined negative pressure level Vp is reached. Then, the three second on-off valves 82 are closed. The decompression pump 73 is stopped.

In the suction process (step S3), while the nozzle surfaces 58*p* of the ejection heads 50 are sealed with the caps 72, a suction operation using the negative pressure of a suction passage among the three suction passages 77*a*, 77*b*, and 77*c* is carried out (first suction process). For example, the first on-off valve 81 of the first suction passage 77*a* is opened and a suction operation using the negative pressure of the first suction passage 77*a* is carried out. After the first suction process is completed, the pressure inside each of the caps 72 will be the same as that of the surrounding environment. Next, a suction operation using the negative pressure of a suction passage among the two unused suction passages 77*b* and 77*c* is carried out (second suction process). For example, the first on-off valve 81 of the second suction passage 77*b* is opened and a suction operation using the negative pressure of the second suction passage 77*b* is carried out.

Next, the first on-off valve 81 of the third suction passage 77*c*, which is the last of the three, is opened and a suction operation using the negative pressure of the third suction passage 77*c* is carried out (third suction process).

The suction device 70D of the fourth embodiment and the suction method using the suction device 70D can obtain the following effects in addition to the effects (1) to (4) of the first embodiment.

(7) The suction passages 77 are separated into the first suction passage 77*a*, the second suction passage 77*b*, and the third suction passage 77*c*; accordingly, suction can be carried out in a stepwise manner by the first suction process having a suction volume V1 that is a product of the volume of the first suction passage 77*a* and the negative pressure level Vp, by the second suction process having a suction volume V2 that is a product of the volume of the second suction passage 77*b* and the negative pressure level Vp, and by the third suction process having a suction volume V3 that is a product of the volume of the third suction passage 77*c* and the negative pressure level Vp.

When the volumes of the first suction passage 77*a*, the second suction passage 77*b*, and the third suction passage 77*c* are the same, suction can be carried out in a stepwise manner in three steps with the same suction volume.

Furthermore, when the volumes of the first suction passage 77*a*, the second suction passage 77*b*, and the third suction passage 77*c* are different, suction can be carried out in a stepwise manner in three steps with different suction volumes.

Compared to a case in which the desired suction volume V is sucked with a single suction operation, since the suction operation is carried out in steps, excessive suction of the functional liquid can be suppressed.

(8) Compared to a configuration in which the three suction passages 77*a*, 77*b*, and 77*c* are connected in series, the three suction passages 77*a*, 77*b*, and 77*c* can be brought to a predetermined negative pressure level Vp quickly. Furthermore, compared with the suction device 70B of the second embodiment and the suction device 70C of the third embodiment, the fourth embodiment can shorten the distance between the first on-off valve 81 and the liquid reservoir 75 and downsize the structure of the overall device.

The invention is not limited to the embodiments described above and any modification that does not depart from the spirit and scope of the invention, which can be read from the claims and the entire description, can be appropriately made. Any modified suction device, suction method, and ejection device that employ such a suction device are also included in the technical scope of the invention. Other than the embodiments described above, various modifications can be conceived. Hereinafter, modifications will be cited and described.

Modification 1

The number of caps 72 connected to a single suction passage 77 is not limited to two in the first to third embodiments described above. A single cap 72 may be connected to a single suction passage 77, or three or more caps 72 may be connected to a single suction passage 77.

Modification 2

The number of suction passages arranged in parallel between the caps 72 and the decompression pump 73 or the liquid reservoir 75 is not limited to three in the fourth embodiment described above. The number thereof may be two or may be four or more.

Modification 3

The ejection device 10 of the first embodiment described above is not limited to one that is capable of ejecting three types of functional liquids (liquids). The number thereof may be two or may be four or more.

Modification 4

The suction method that uses the negative pressure of the suction passage 77 is not limited to the suction methods of the first to fourth embodiments described above. For example, in the decompressing process using the suction device 70A of FIG. 6, the nozzle surfaces 58*p* are sealed by the caps 72 while the functional liquid is stopped from being supplied to the ejection head 50. Next, the first on-off valve 81 and the second on-off valve 82 are opened, the decompression pump 73 is driven, and the suction passage 77 and the suction passage 78 are brought to a predetermined negative pressure state Vp, and, then, the first on-off valve 81 and the second on-off valve 82 are closed. Next, in the suction process, supply of the functional liquid to the ejection head 50 is resumed. Accordingly, it will be possible to suck out the functional liquid, with which the ejection heads 50 have been filled, from the plurality of nozzles 58 by using the negative pressure of the suction passage 78 between the cap bases 72*a* and the first on-off valve 81. If elimination of the nozzle clogging is insufficient with this suction operation, the first on-off valve 81 is opened and a suction operation using the negative pressure of the suction passage 77 can be carried out.

Modification 5

The ejection head 50 is not limited to one that has a plurality of nozzles 58; the ejection head 50 may be configured to have a single nozzle 58.

Modification 6

The decompression pump 73 serving as a decompression device is not limited to one that is configured to exhibit a constant suction force at all times during the compression. The decompression pump 73 may include a configuration that varies the suction force. With the above, the suction volume V of the suction device 70A can be controlled with the decompression pump 73 with high precision. Furthermore, for example, when the functional liquid is sucked out from the ejection head 50 in a stepwise manner, by differentiating the suction force when the first suction passage 77*a* is brought to a negative pressure and the suction force when the second suction passage 77*b* is brought to a negative pressure, it will be possible to easily differentiate the negative pressure level of the first suction passage 77*a* and that of the second suction passage 77*b*.

The entire disclosure of Japanese Patent Application No. 2013-020174, filed Feb. 5, 2013 is expressly incorporated by reference herein.

What is claimed is:

1. A suction device for an ejection head provided with a nozzle, comprising:

a cap that is capable of sealing a nozzle surface provided with the nozzle;

a decompression device;

a suction passage provided between the cap and the decompression device, a first valve provided in the suction passage on the cap side thereof; and a second valve provided in the suction passage on the decompression device side thereof;

the decompression device being disposed other than between the first valve and the second valve, a liquid with which the ejection head has been filled is sucked out from the nozzle via the cap by controlling a negative pressure level of the suction passage on the basis of a volume of the suction passage between the first valve and the second valve with the decompression device.

2. The suction device according to claim 1, the ejection head including a liquid supply port, a plurality of the nozzles, and a cavity that is in communication with the plurality of the nozzles, and the negative pressure level of the suction passage is set such that an amount of the liquid equal to or less than a volume from the liquid supply port to the plurality of the nozzles including the cavity is sucked out.

3. The suction device according to claim 1, the suction passage including a first suction passage and a second suction passage that are connected in series through a third valve.

4. The suction device according to claim 3, a volume of the first suction passage and a volume of the second suction passage being substantially the same.

5. The suction device according to claim 3, a volume of the first suction passage and a volume of the second suction passage being different.

6. The suction device according to claim 1, a volume of the cap when the nozzle surface is sealed being smaller than a volume of the suction passage.

7. The suction device according to claim 1, the suction passage being connected to a plurality of the caps, and a volume of the plurality of the caps when sealing a plurality of the nozzle surfaces therewith being smaller than a volume of the suction passage.

8. An ejection device, comprising:

an ejection head, and the suction device according to claim 1.

9. An ejection device, comprising:

an ejection head, and the suction device according to claim 2.

10. An ejection device, comprising:

an ejection head, and the suction device according to claim 3.

11. The suction device according to claim 1, further comprising:

a suction bypass passage connected in parallel with the suction passage, the suction bypass passage connected between the cap and the decompression device, and the suction bypass passage configured to bypass the suction passage.

12. A suction method of sucking a liquid with which an ejection head has been filled out from a nozzle via a cap that is capable of sealing a nozzle surface provided with the nozzle, the suction method comprising:

using a suction device including a decompression device, a suction passage provided between the cap and the decompression device, a first valve provided in the suction passage on the cap side thereof, and a second valve provided in the suction passage on the decompression device side thereof, the decompression device being located other than between the first valve and the second valve;

decompressing the suction passage to a predetermined negative pressure level with the decompression device by closing the first valve and opening the second valve; and sucking by opening the first valve after closing the first valve, closing the second valve, and sealing the nozzle surface with the cap.

13. The suction method according to claim 12, the ejection head including a liquid supply port, a plurality of the nozzles, and a cavity that is in communication with each of the plurality of the nozzles, and during the decompressing, the negative pressure level of the suction passage being set such that the amount of liquid equal to or less than a volume from the liquid supply port to the plurality of nozzles including the cavity is sucked out during the sucking.

14. The suction method according to claim 12, the suction passage including a first suction passage and a second suction passage that are connected in series through a third valve, and the sucking including a first suction process in which sucking is performed by opening the first valve and closing the third valve and the second valve and a second suction process, performed after the first suction process, in which sucking is performed by opening the third valve.

15. The suction method according to claim 12, further comprising:

discharging the liquid remaining inside the suction passage before the decompressing.

16. A suction device for an ejection head provided with a nozzle, comprising:

a cap that is capable of sealing a nozzle surface provided with the nozzle;

a decompression device;

and a suction passage provided between the cap and the decompression device, a liquid with which the ejection head has been filled is sucked out from the nozzle via the cap by controlling a negative pressure level of the suction passage on the basis of a volume of the suction passage with the decompression device;

the suction passage including:

a first suction passage and a second suction passage that are connected in parallel, a first valve being provided on each of the cap side of the first suction passage and the second suction passage, and a second valve being provided on each of the decompression device side of the first suction passage and the second suction passage.

17. A suction method of sucking a liquid with which an ejection head has been filled out from a nozzle via a cap that is capable of sealing a nozzle surface provided with the nozzle, the suction method comprising:

using a suction device including:

a decompression device, a suction passage provided between the cap and the decompression device, a first valve provided in the suction passage on the cap side thereof, and a second valve provided in the suction passage on the decompression device side thereof;

decompressing the suction passage to a predetermined negative pressure level with the decompression device by closing the first valve and opening the second valve; and sucking by opening the first valve after closing the first valve, closing the second valve, and sealing the nozzle surface with the cap;

the suction passage including:

a first suction passage and a second suction passage that are connected in series through a third valve, and a suction bypass passage that is connected between the cap and the decompression device and that is connected in parallel with the first suction passage and the second suction passage, the suction bypass passage bypassing the first suction passage and the second suction passage, and the sucking including:

a first suction process in which sucking is performed by opening the first valve and closing the third valve and the second valve, a second suction process in which sucking is performed by opening the third valve after the first suction process, and a third suction process in which sucking is performed by closing the second valve and through the suction bypass passage with the decompression device.

18. A suction method of sucking a liquid with which an ejection head has been filled out from a nozzle via a cap that is capable of sealing a nozzle surface provided with the nozzle, the suction method comprising;

using a suction device including:

a decompression device, a suction passage provided between the cap and the decompression device, a first valve provided in the suction passage on the cap side thereof, and a second valve provided in the suction passage on the decompression device side thereof;

decompressing the suction passage to a predetermined negative pressure level with the decompression device by closing the first valve and opening the second valve; and sucking by opening the first valve after closing the first valve, closing the second valve, and sealing the nozzle surface with the cap;

the suction passage including:

a first suction passage and a second suction passage that are connected in parallel, the first suction passage and the second suction passage each include a first valve and a second valve, and the sucking including:

a first suction process in which sucking is performed by closing the first valve and the second valve of the second suction passage, closing the second valve of the first suction passage, and opening the first valve of the first suction passage, and a second suction process in which, after the first suction process, sucking is performed by closing the first valve of the first suction passage and opening the first valve of the second suction passage.

* * * * *